US012391348B1

(12) United States Patent
Way

(10) Patent No.: US 12,391,348 B1
(45) Date of Patent: Aug. 19, 2025

(54) FLOATING LIFT SYSTEM FOR FLOATING OR FIXED DOCKS AND METHOD OF USE

(71) Applicant: Robert Lindsay Way, Brunswick, GA (US)

(72) Inventor: Robert Lindsay Way, Brunswick, GA (US)

( * ) Notice: Subject to any disclaimer, the term of this patent is extended or adjusted under 35 U.S.C. 154(b) by 505 days.

(21) Appl. No.: 17/963,718

(22) Filed: Oct. 11, 2022

Related U.S. Application Data

(63) Continuation-in-part of application No. 17/108,899, filed on Dec. 1, 2020, now Pat. No. 11,465,717.

(51) Int. Cl.
*B63C 1/06* (2006.01)

(52) U.S. Cl.
CPC ..... *B63C 1/06* (2013.01)

(58) Field of Classification Search
CPC ..... B63C 1/06; B63C 1/02
See application file for complete search history.

(56) References Cited

U.S. PATENT DOCUMENTS

| | | | | |
|---|---|---|---|---|
| 4,226,202 | A * | 10/1980 | Conrad | B63B 27/36 114/263 |
| 6,032,601 | A * | 3/2000 | Gates | B63C 1/02 114/45 |
| 7,603,959 | B1 * | 10/2009 | Veazey | E02B 3/062 114/263 |
| 9,517,820 | B2 * | 12/2016 | Fuhrmann | B63C 1/02 |
| 10,131,410 | B2 * | 11/2018 | Blume | B63C 3/06 |
| 10,745,092 | B2 * | 8/2020 | Lydle | B63C 15/00 |
| 2017/0190398 | A1 * | 7/2017 | Barnes | B63C 1/06 |
| 2019/0210700 | A1 * | 7/2019 | Cibilich | B63C 3/02 |

FOREIGN PATENT DOCUMENTS

WO WO-2004022421 A1 * 3/2004 ..... B63B 23/32

* cited by examiner

*Primary Examiner* — S. Joseph Morano
*Assistant Examiner* — Jovon E Hayes
(74) *Attorney, Agent, or Firm* — Richard Eldredge; Leavitt Eldredge Law Firm

(57) ABSTRACT

A floating lift system capable of fully integrating into an existing floating or fixed dock or into a floating or fixed dock currently in construction that allows users to employ a plurality of utilitarian uses, thereby providing for enhanced user experience. The floating lift system includes an elevator deck; a lift deck; and an air control system. The floating lift system allows for the raising and lowering of load into and out of water.

9 Claims, 27 Drawing Sheets

FLOATING LIFT SYSTEM FOR FLOATING OR FIXED DOCKS AND METHOD OF USE

CROSS REFERENCE TO RELATED APPLICATIONS

This application is a continuation of U.S. application Ser. No. 17/108,899, filed on Dec. 1, 2020, of which is hereby incorporated by reference in its entirety.

BACKGROUND

1. Field of the Invention

The present invention relates generally to floating watercraft lift systems, and more specifically to a floating lift system that utilizes an elevator deck extension for raising and lowering load into and out of water, wherein the elevator deck extension is coupled complementarily to a parent floating or fixed dock, thereby providing an aesthetically pleasing appearance for the parent floating or fixed dock.

2. Description of Related Art

Floating watercraft lift systems are well known in the art and are effective means for raising vessels out of the water for maintenance, repair, or storage. Conventional floating watercraft lift systems utilize one of two methods to raise and lower vessels by employing a series of ballast floats that delivers and discharges air therefrom. In the first method, ballast floats only partially submerge in water during vessel launching or retrieval. Ballast floats are typically tied down via rope to a cleat on a floating or fixed dock to prevent the vessel and the ballast from floating away. In the second method, ballast floats completely submerge into water during vessel launching. Unlike in the first method, the second method requires the ballast floats to be mechanically connected to a fixed mass such as a fixed or floating dock.

One of the problems associated with current floating watercraft lift systems is their overall arrangement. Current floating watercraft lift systems do not provide an avenue to fully integrate into a floating or fixed dock and thus interrupts the overall aesthetic appearance of the floating or fixed dock. Moreover, current floating watercraft lift systems are limited to raising only vessels, thereby requiring users to employ other means for raising and lowering loads into and out of water.

Hence, it would be advantageous to have a system that fully integrates into a parent floating or fixed dock, thereby providing an aesthetically pleasing appearance for the parent floating or fixed dock. In addition, it would be advantageous to have a system that raises and lowers any type of load into and out of water and offers additional usable deck surface area, thereby providing utilitarian uses.

Accordingly, although great strides have been made in the area of floating watercraft lift systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1A:
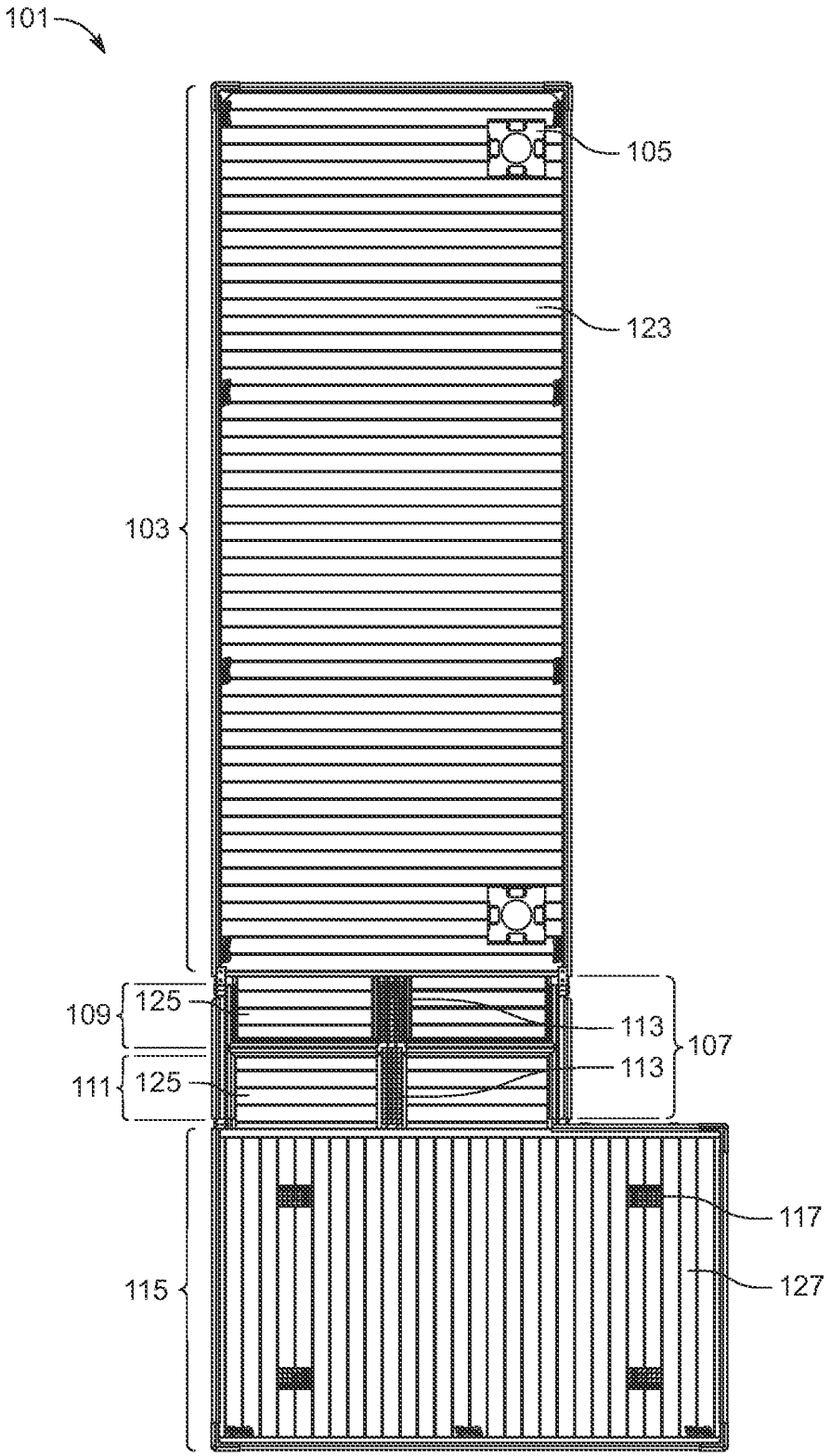
FIG. 1A is a top view of a floating lift system fully raised in accordance with one or more embodiments of the present invention.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional floating dock lift systems. Specifically, the present invention provides a system that can fully integrate into an existing floating or fixed dock, creating a harmonious union, thereby providing for improved aesthetic appearance. In addition, the system of the present invention allows the user to employ a plurality of utilitarian uses, thereby providing for enhanced user experience. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIGS. 1A-1D depict various views of a floating lift system in accordance with one or more embodiments of the present application. It will be appreciated that floating lift system 101 overcomes one or more of the above-listed problems commonly associated with conventional floating watercraft lift systems. It should also be appreciated that the floating lift system 101 may vary based on aesthetical, functional, or manufacturing considerations.

Figure 7:
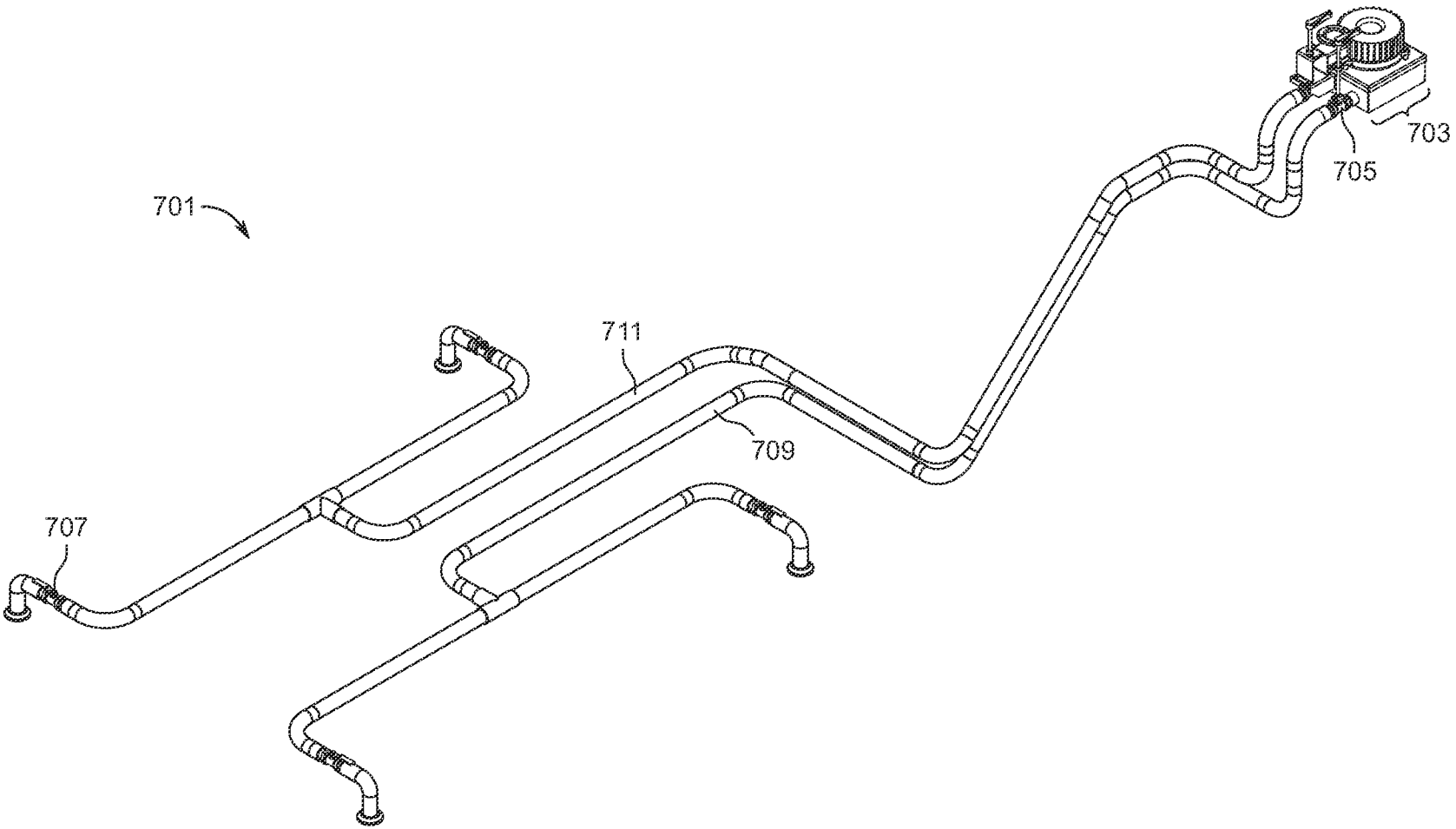
FIG. 7 is a schematic of an air control system in accordance with one or more embodiments of the present invention.

In the contemplated embodiment, floating lift system 101 includes an elevator deck 107, a lift deck 115, and an air control system (not shown, see FIG. 7 for further discussion). The elevator deck 107 comprises of a parent dock adapter 109, a lift deck adapter 111, one or more grating covers 113, and a walking surface area 125. The parent dock adapter 109 is configured to securely attach the elevator deck 107 to a parent dock 103. The one or more grating covers 113 are configured to conceal the link arms (not shown, see FIG. 3 for further discussion) connecting the parent dock adapter 109 and the lift deck adapter 111. The lift deck adapter 111 is configured to securely attach the lift deck 115 to the parent dock adapter 109 via two or more link arm sets (not shown, see FIG. 3 for further discussion).

It should be appreciated that the parent dock 103 can be any existing floating or fixed dock or any floating or fixed dock currently in construction. It should also be appreciated that the parent dock 103 can include one or more pilings 105, one or more foam-filled static floats 121, and a walking surface area 123.

Figure 1B:
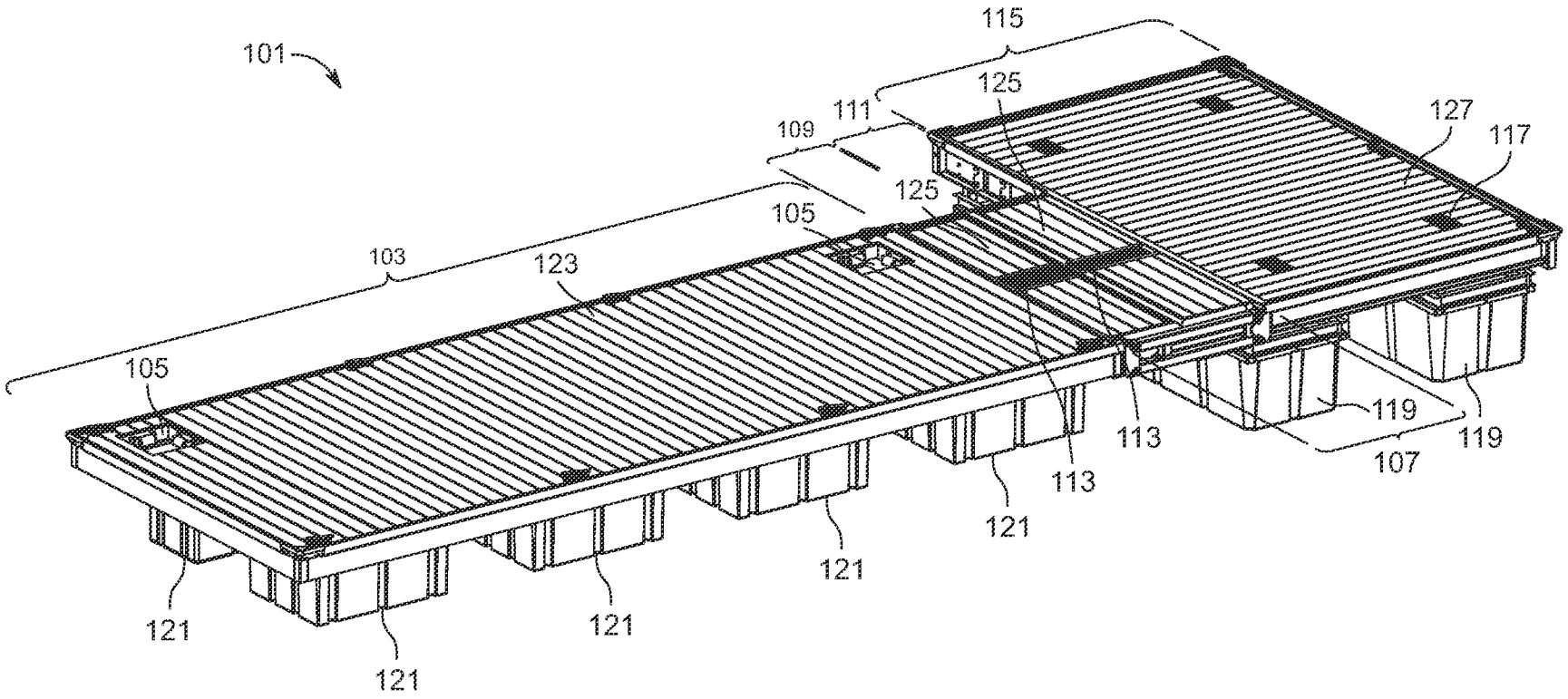
FIG. 1B is a rear perspective view of a floating lift system fully raised in accordance with one or more embodiments of the present invention.
Figure 1C:
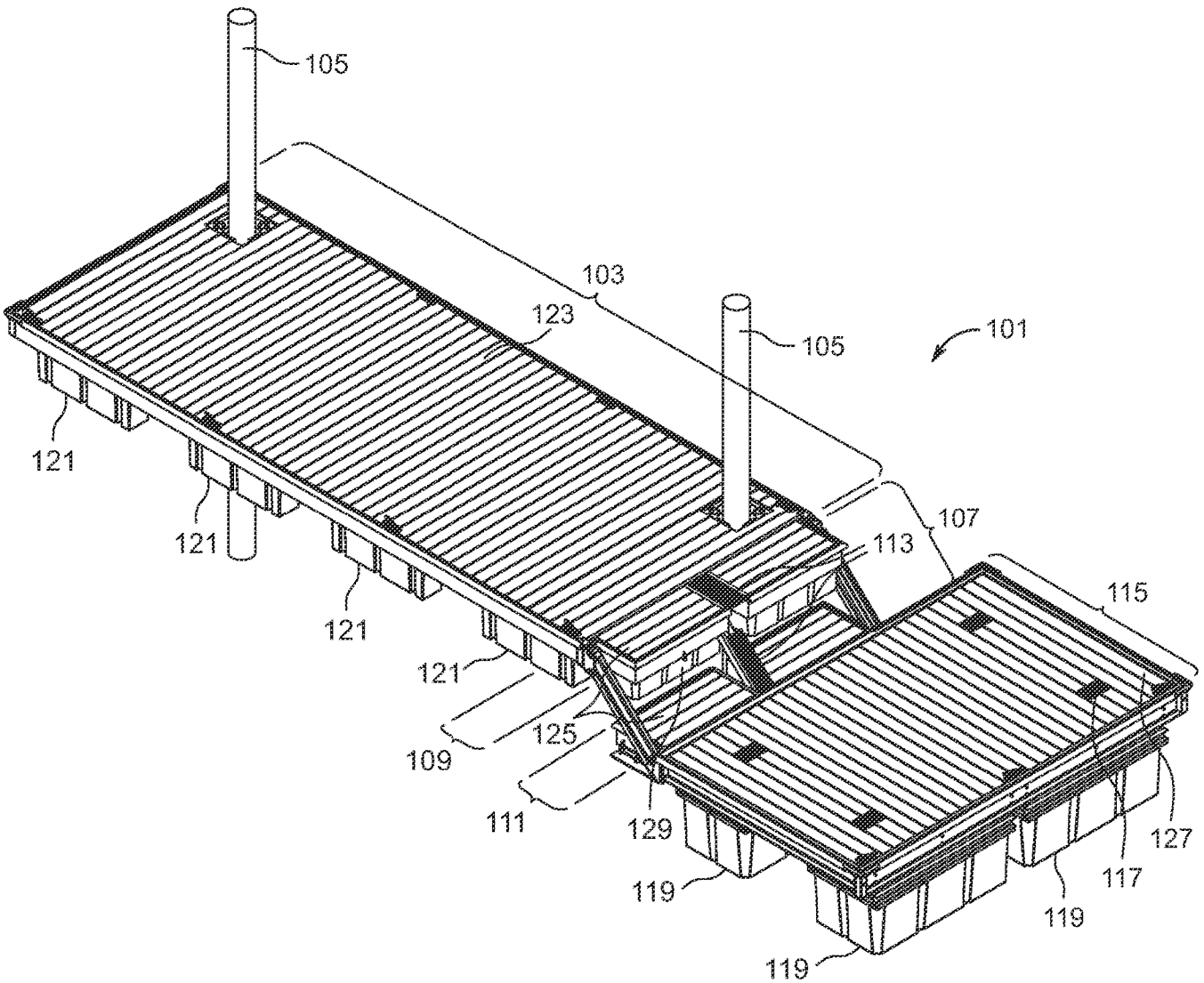
FIG. 1C is a left perspective view of a floating lift system fully lowered in accordance with one or more embodiments of the present invention.

In some embodiments, the lift deck 115 comprises of one or more vessel support bunks 411 (not shown, see FIG. 4 for further detail), one or more hollow lift floats 119, and a walking surface area 127, as shown in FIGS. 1A-1C. The one or more hollow lift floats 119 couple directly beneath the lift deck 115.

It should be appreciated that the one or more vessel support bunks 411 (not shown, see FIG. 4 for further detail) can be removable and the deck opening can be concealed with one or more coverings 117 to further enhance the overall aesthetic appearance. It should also be appreciated that although the elevator deck 107 is shown at the end of the parent floating dock 109, it is contemplated that the attachment of the elevator deck 107 to the parent floating dock 103 can vary in location, size, style, and the like.

In some embodiments, the parent dock adapter 109 may include one or more parent dock adapter foam-filled static floats 129 coupled thereunder configured to offset the weight of the dead weight of the parent dock adapter 109 as the one or more hollow lift floats 119 merge into water.

Figure 1D:
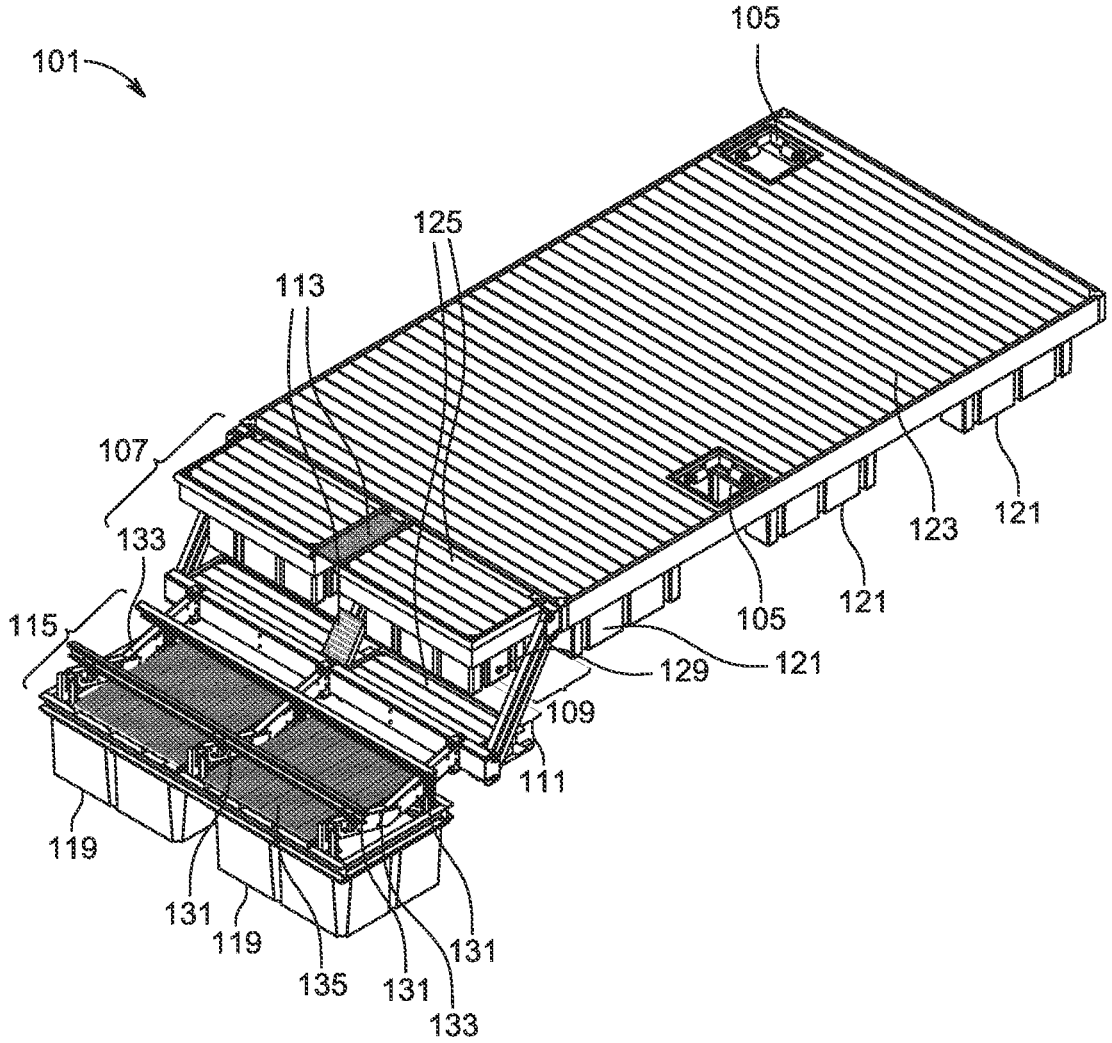
FIG. 1D is a right perspective view of a floating lift system fully lowered in accordance with one or more embodiments of the present invention.

In other embodiments, the lift deck 115 includes a v-hull bunking adapter 131 in lieu of a flat walk deck, as shown in FIG. 1D. The v-hull bunking adapter 131 includes one or more support arms 133 configured to support a v-hull vessel. The lift deck 115 also includes a grate walk deck 133 configured to allow a user to walk across the v-hull bunking adapter 131 safely.

In some embodiments, a user may utilize the walking surface areas 125, 127 as an extension of the walking surface area 123 of the parent dock 103 while the system is in the fully raised position. In one embodiment, the user may use the lift deck 115 to readily descend into and/or ascend from water during various activities including, without limitation, swimming, diving, aquatic physical therapy, and the like. In another embodiment, the user may use the lift deck 115 to readily raise and lower vessels into water including, without limitation, motorboats, canoes, kayaks, speedboats, rowboats, or the like.

It should also be appreciated that one of the unique features believed characteristic of the present application is the configuration of the elevator deck and the lift deck that allows for uniform integration to a parent dock. In addition, the installation of the air control system does not disrupt the aesthetic appearance of the parent dock, thereby providing for an overall uniform façade.

Figure 2:
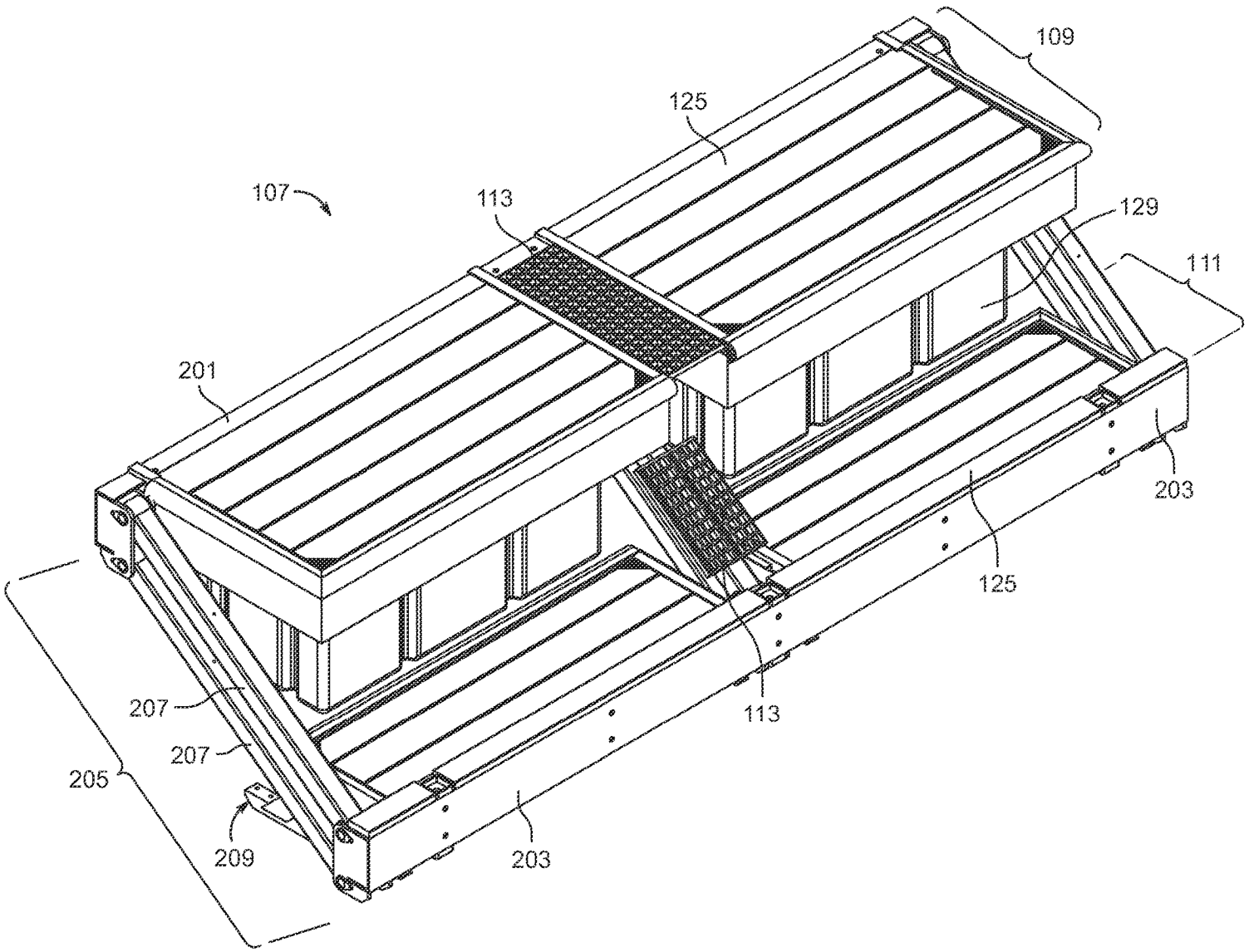
FIG. 2 is a perspective view of the elevator deck of FIGS. 1A-1D in accordance with one or more embodiments of the present application.

In FIG. 2, a perspective view of the elevator deck assembly 107 is shown. The elevator deck assembly 107 includes a parent dock adapter mount 201, a lift deck spar beam 203, one or more sets 205 of link arms 207, one or more parent dock adapter foam-filled static floats 129, and one or more lift deck adapter up stops 209. The parent dock adapter mount 201 is configured to couple the parent dock adapter 109 to any location of the parent dock 103. The one or more lift deck adapter up stops 209 are configured to prevent the lift deck adapter 111 and the lift deck 115 from being raised to an elevation higher than the parent dock 103.

Figure 3:
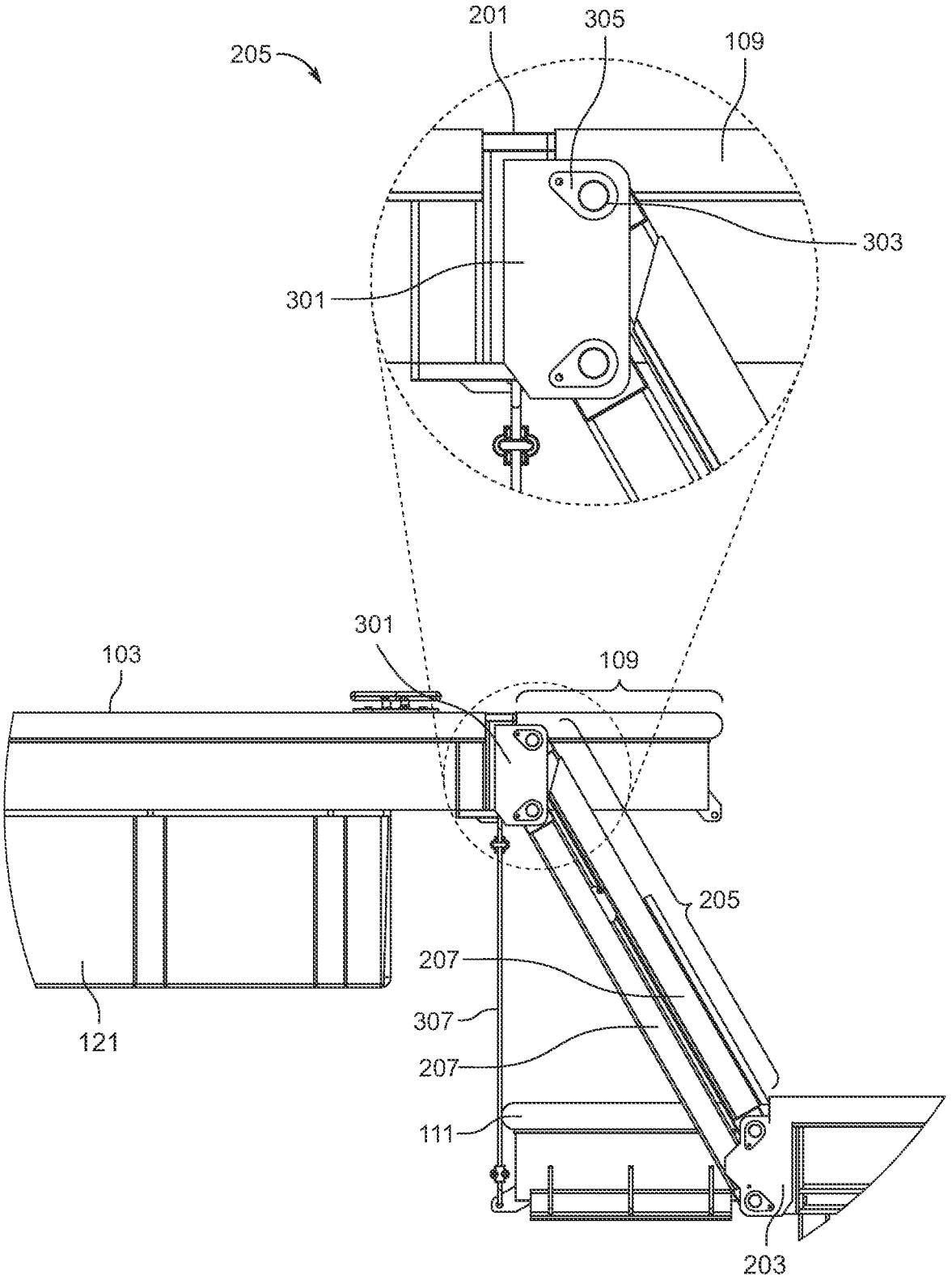
FIG. 3 is a profile view of a set of link arms of the elevator deck of FIGS. 1A-1D in a lowered position in accordance with one or more embodiments of the present application.

In FIG. 3, profile view of a set 205 of link arms 207 of the elevator deck 107 of FIGS. 1A-1D in a lowered position is shown. Each end of the set 205 of link arms 207 includes one or more link arm side plates 301, one or more pivot pins 303, and one or more pin captive fasteners 305. The link arm side plates 301, pivot pins 303, and pin captive fasteners 305 are configured to connect the first end of the set 205 of link arms 207 to the parent dock adapter mount 201 and connect the second end of the set 205 of link arms 207 to the lift deck spar beam 203. The floating dock lift system 101 also includes one or more down limit cables 307 configured to connect the parent dock adapter 109 and the lift deck adapter 111.

Figure 4:
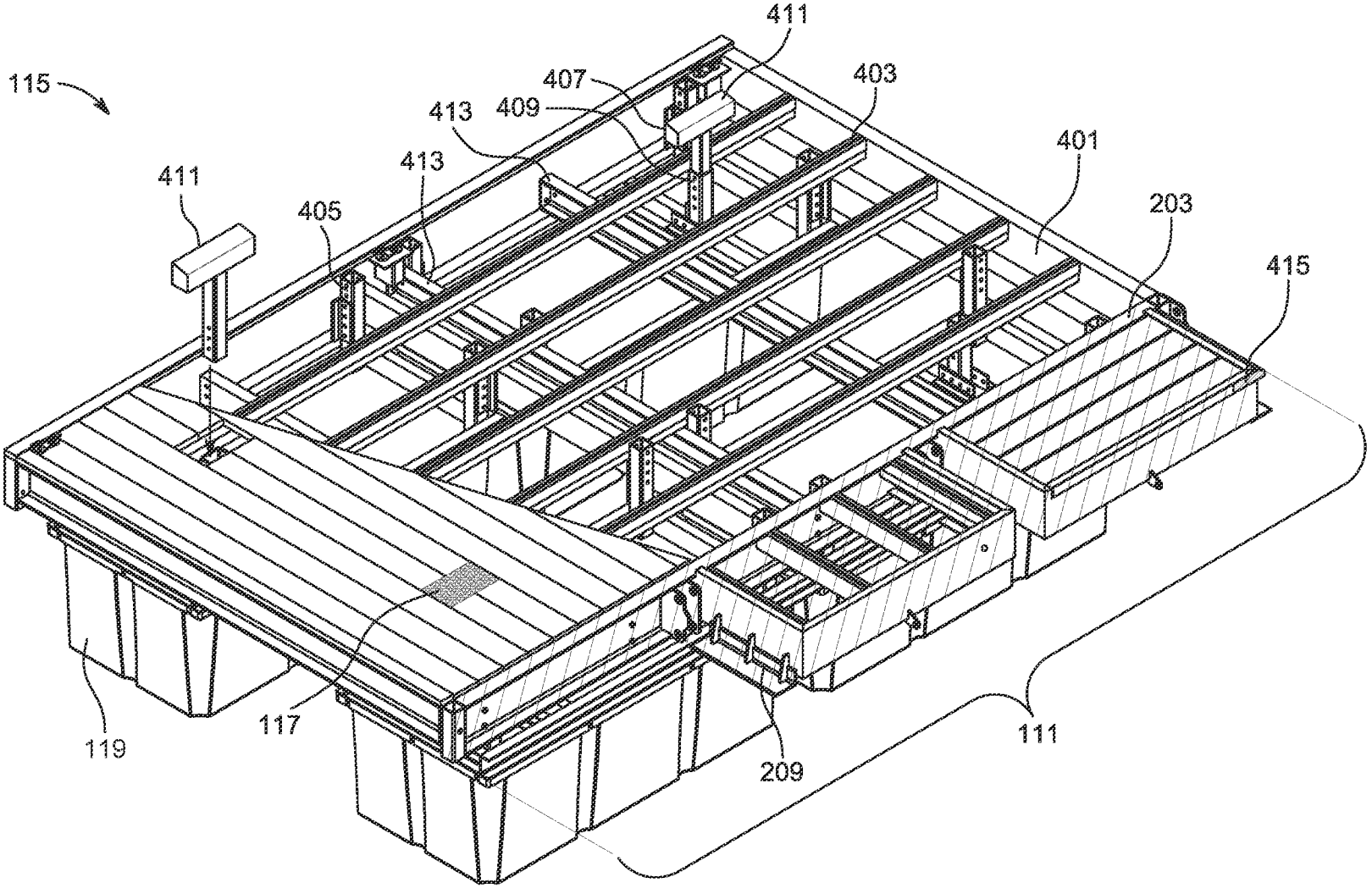
FIG. 4 is a perspective view of the lift float of FIGS. 1A-1C with the walking surface area partially removed in accordance with one or more embodiments of the present application

In FIG. 4, a perspective view of the lift deck 115 of FIGS. 1A, 1B and 1C with the walking surface area 127 partially removed is shown. As stated above, the lift deck 115 includes one or more vessel support bunks 411. It should be appreciated that the one or more vessel support bunks 411 can comprise of any material suitable to prevent the hull of a vessel from being damaged including, without limitation, carpet, wood, plastic, and metal.

The lift deck 115 also includes a frame 401 with integrated lift deck spar beam 203, one or more aluminum deck joists 403, one or more deck frame piers 405, one or more deck frame pier brackets 407, and one or more bunk post receivers 409. The one or more bunk post receivers 409 are configured to receive the one or more vessel support bunks 411, as depicted with directional arrows. The lift deck 115 further includes one or more deck cross-members 413, and one or more vinyl rub rails 415.

Figure 5A:
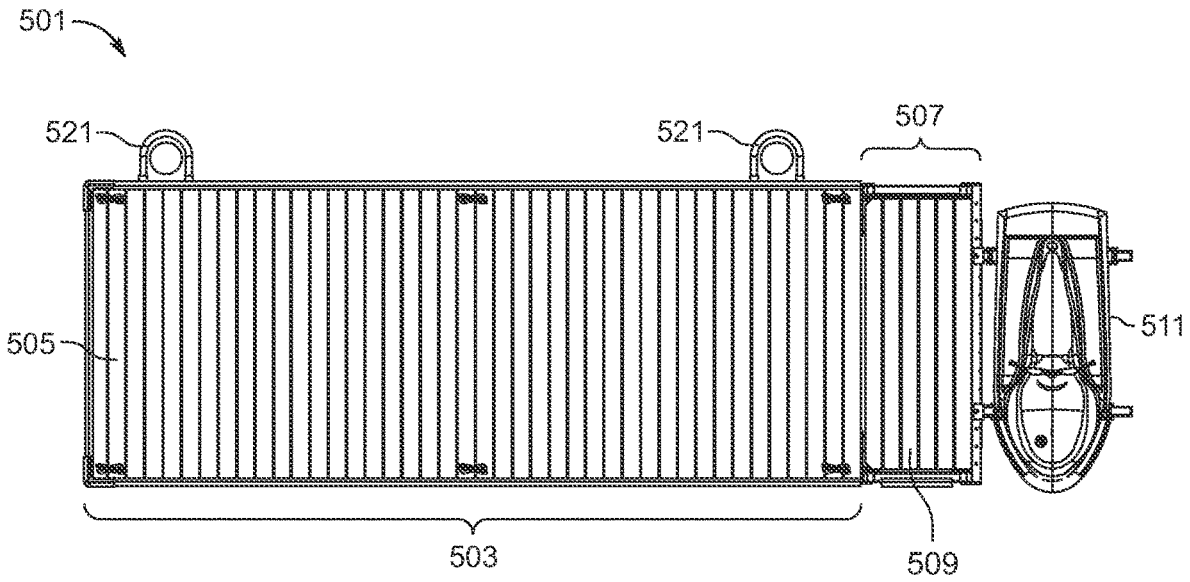
FIG. 5A is a top view of an alternative floating lift system fully raised with a watercraft in accordance with one or more embodiments of the present invention.
Figure 5B:
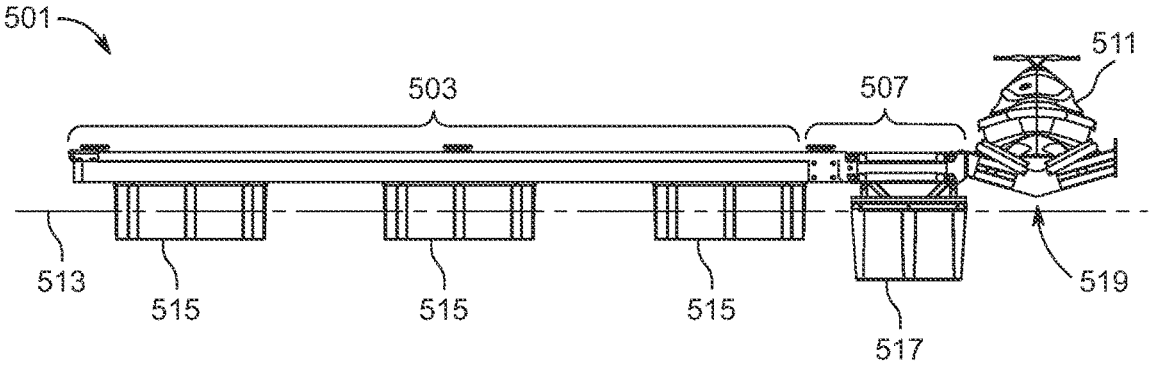
FIG. 5B is a profile view of an alternative floating lift system fully raised with a watercraft in accordance with one or more embodiments of the present invention.
Figure 5C:
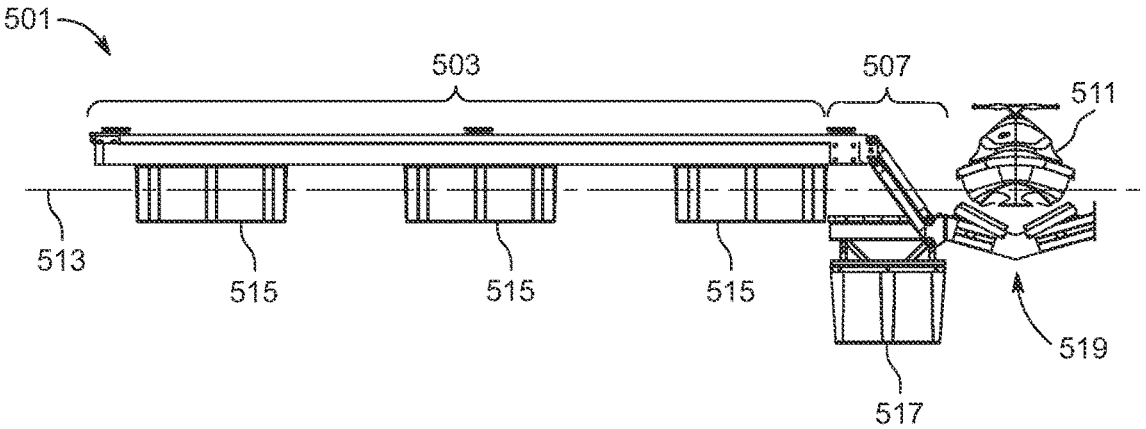
FIG. 5C is a profile view of an alternative floating lift system fully lowered with a watercraft in accordance with one or more embodiments of the present invention.

Referring now to FIGS. 5A, 5B and 5C, various views of an alternative floating lift system 501 are depicted. In this embodiment, the floating lift system 501 includes a lift deck 507 and an air control system (not shown, see FIG. 7 for further discussion). The lift deck 507 comprises of a walking surface area 509 and one or more hollow lift floats 517. The lift deck 507 is configured to securely attach to a parent dock 503. The one or more hollow lift floats 517 couple directly underneath the lift deck 507.

It should be appreciated that the parent dock 503 can be any existing floating or fixed dock or any floating or fixed dock currently in construction. In addition, it should be appreciated that the parent dock 503 can include one or more foam-filled static floats 515, one or more pilings 521, and a walking surface area 505. It should also be appreciated that although the lift deck 507 is shown at the end of the parent floating dock 503, it is contemplated that the attachment of the lift deck 507 to the parent dock 503 can vary in location, size, style, and the like.

As shown, the lift deck 507 also includes one or more sets of cradle arms 519 configured to support a vessel 511 including, without limitation, a motorboat, a canoe, a kayak, a speedboat, a rowboat, or the like. In the contemplated embodiment, the lift deck 507 is configured to raise the vessel 511 above the water line 513 and to lower the vessel 511 below the water line 513.

Figure 6:
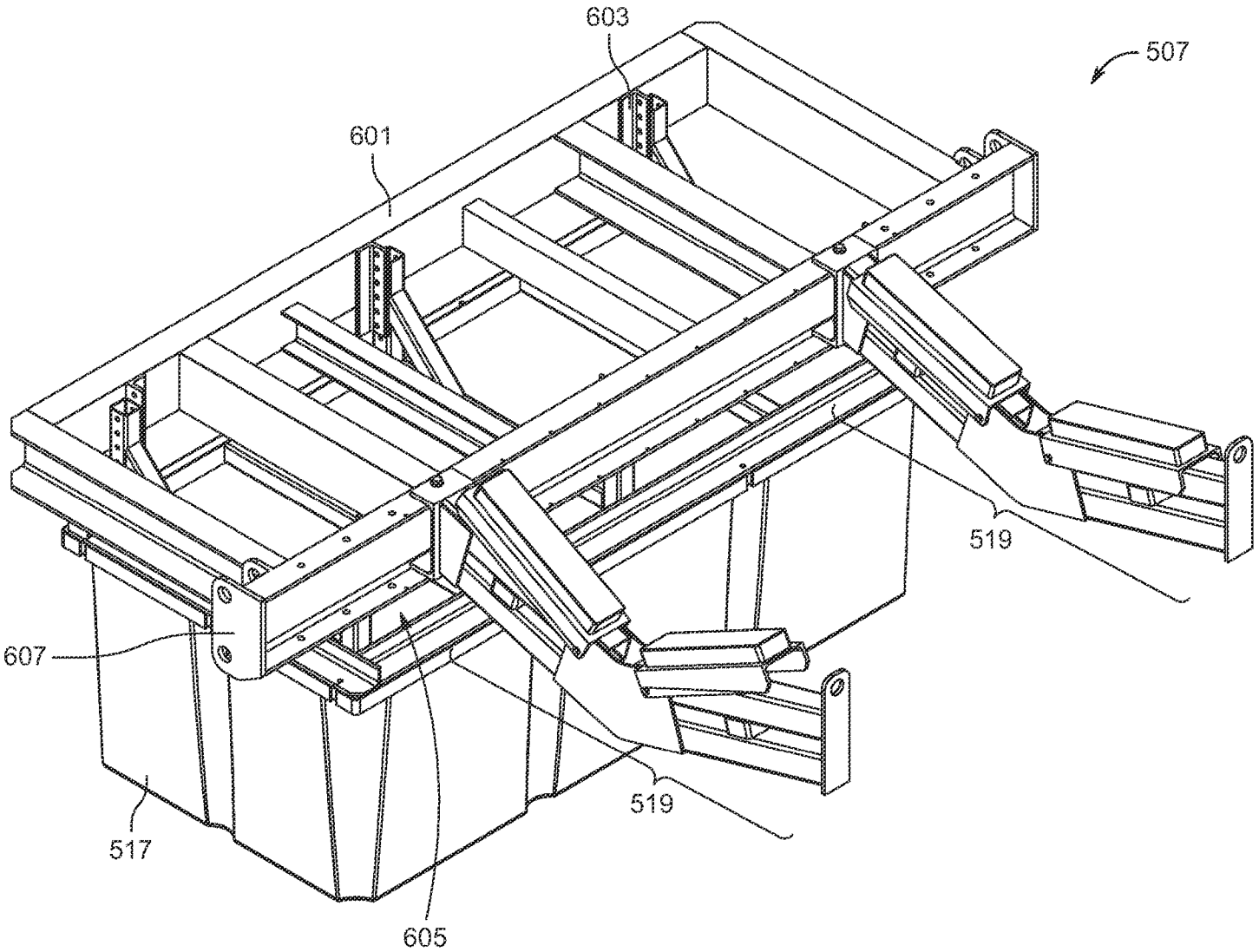
FIG. 6 is a perspective view of the elevator deck of FIGS. 5A-5C with the walking surface area removed in accordance with one or more embodiments of the present application.

In FIG. 6, a perspective view of the lift deck 507 of FIGS. 5A, 5B and 5C with the walking surface area 509 removed is shown. As depicted, the cradle arms 519 are cantilevered and extend away from the lifting float and do not incorporate an elevator deck (see the elevator deck 107 in FIG. 1D) and an elevator deck static float (see the elevator deck static float 129 in FIG. 1C). In addition, the lift deck 507 further includes a frame 601, one or more deck frame pier brackets 603, one or more riser beams 605, and one or more pivot pins 607.

In FIG. 7, a schematic of an air control system 701 is depicted. The air control system 701 is configured to manage the pressurized air within the one or more hollow lift floats 119, 517. The air control system 701 includes an air box valve and centrifugal blower 703, one or more air box control ball valves 705, one or more isolation ball valves 707, a forward air hose circuit 709, and a rear air hose circuit 711. It should be appreciated that the installation of air control system 701 within lift systems 101, 501 allows for an overall uniform façade of parent decks 103, 503.

Figure 8:
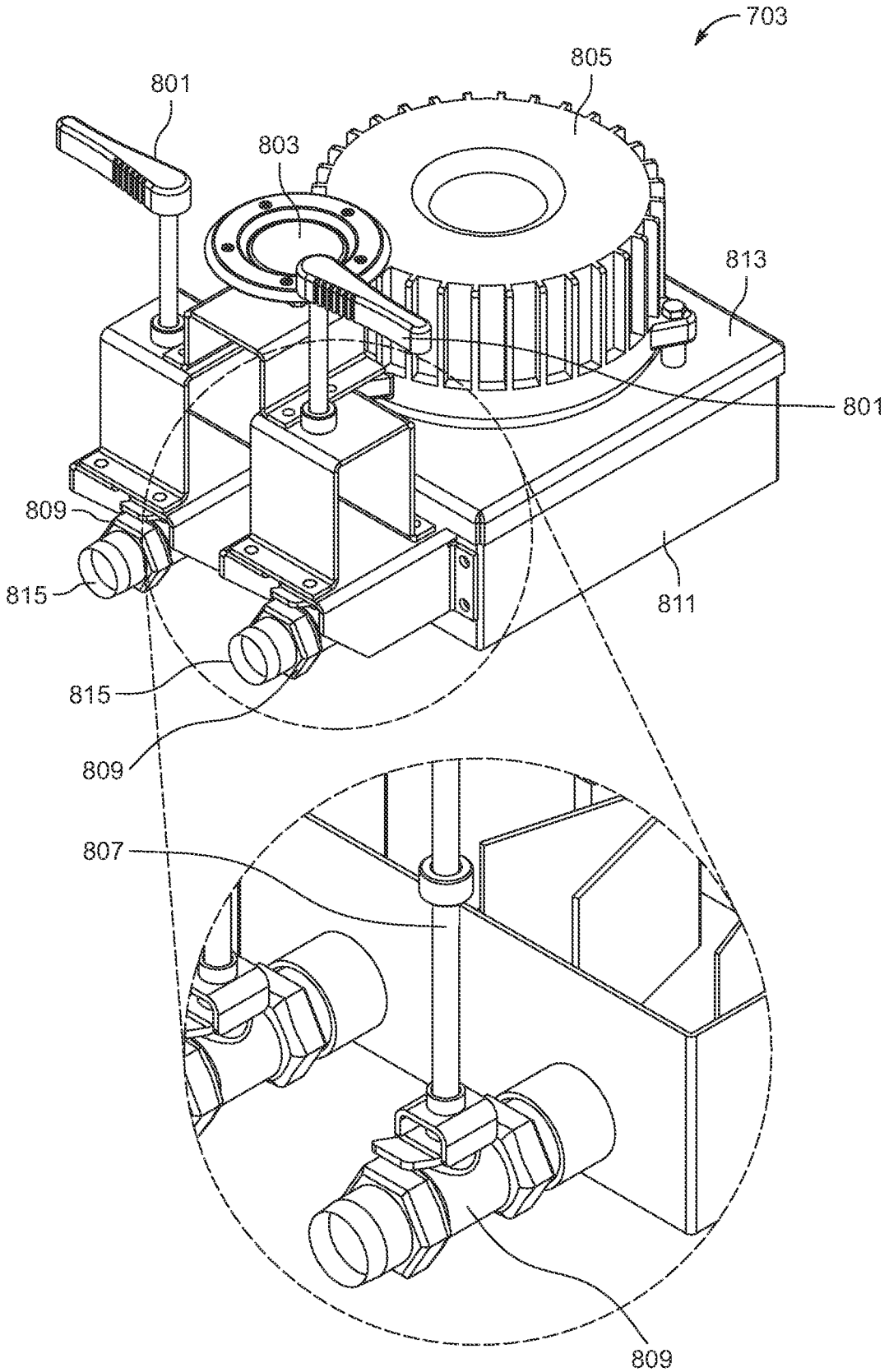
FIG. 8 is a perspective view of the air box valve and blower of the air control system of FIG. 7 in accordance with one or more embodiments of the present application.

In FIG. 8, a perspective view of the air box valve and centrifugal blower 703 of the air control system 701 is depicted. The air box valve and centrifugal blower 703 includes one or more manual air valve operators 801, an operator blower-foot switch 803, an air blower 805, a valve actuator rod-air valve 807, one or more ball valves 809, an air box plenum 811, a plenum cover-blower base 813, and one or more barbed hose fittings 815. It should be appreciated that the one or more manual air valve operators 801 can employ electric solenoids to electrically operate the air valve operators.

During use, when the user engages the one or more manual air valve operators 801 to lower the lift deck 115, air trapped within the one or more hollow lift floats 119, 517 escape to the atmosphere via the open-air circuit in the top of the lift floats 119, 517 whilst water is allowed to surge into the hollow lift floats 119, 517 via permanent openings the bottom of the hollow lift floats 119, 517, thereby causing the lift deck 515 to descend. The lift deck 115 continues to descend until either the one or more air valve operators 801 are closed, the lift deck 115 reaches the end of mechanical travel, or the slack in the one or more down limit cables 307 is taken up.

Additionally, during use, when the user engages the one or more manual air valve operators 801 to raise the lift deck 115, the operator blower-foot switch 803 is depressed. As the operator blower-foot switch 803 is acted upon, air is pumped into the one or more hollow lift floats 119, 517 via the air blower 805, forcing water by displacement within the one or more hollow lift floats 119, 517 to discharge through the permanent openings in the bottom of the hollow lift floats 119, 517.

Figure 9A:
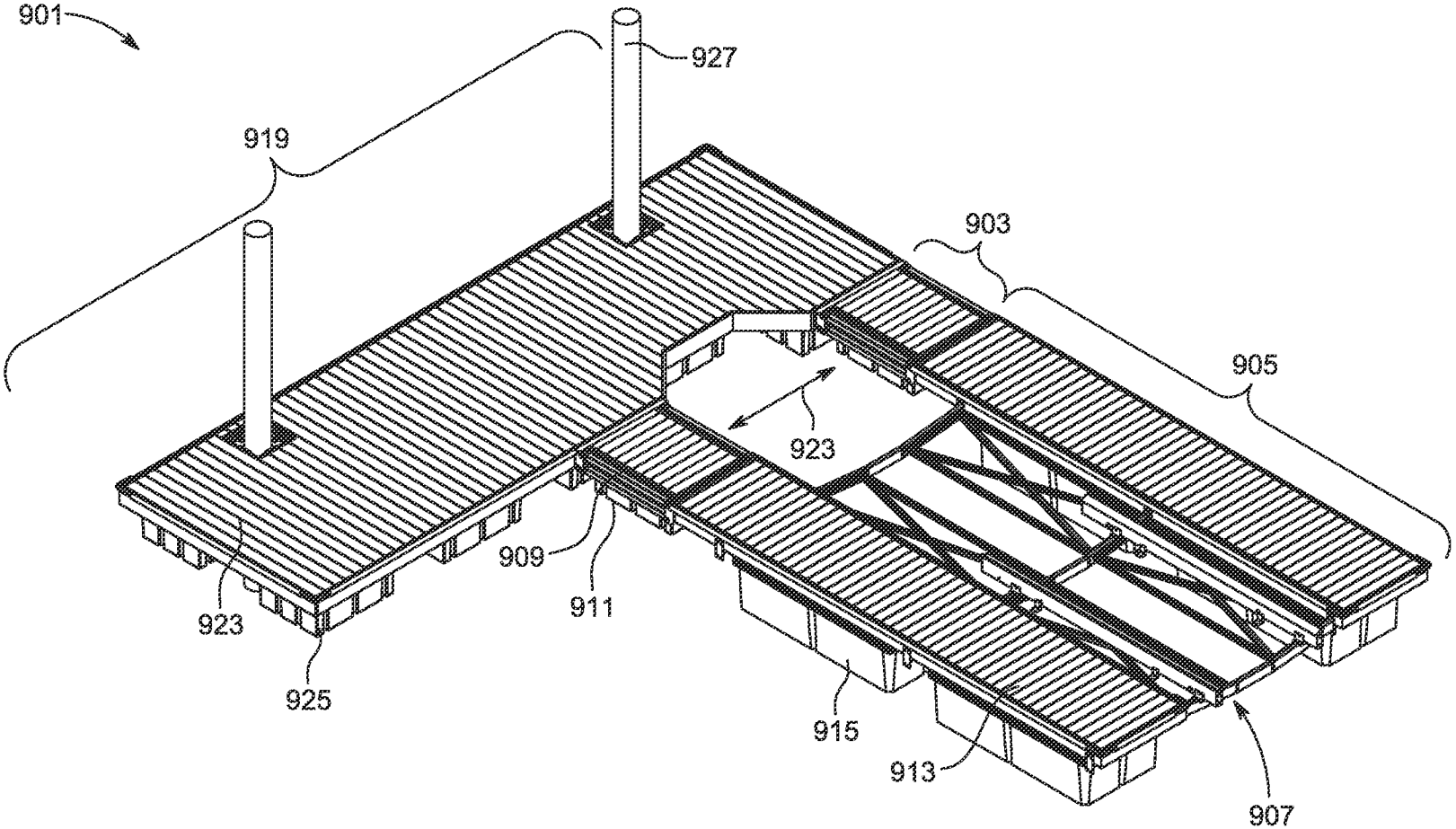
FIG. 9A is a perspective view of a floating lift system fully raised in accordance with one or more embodiments of the present invention.
Figure 9B:
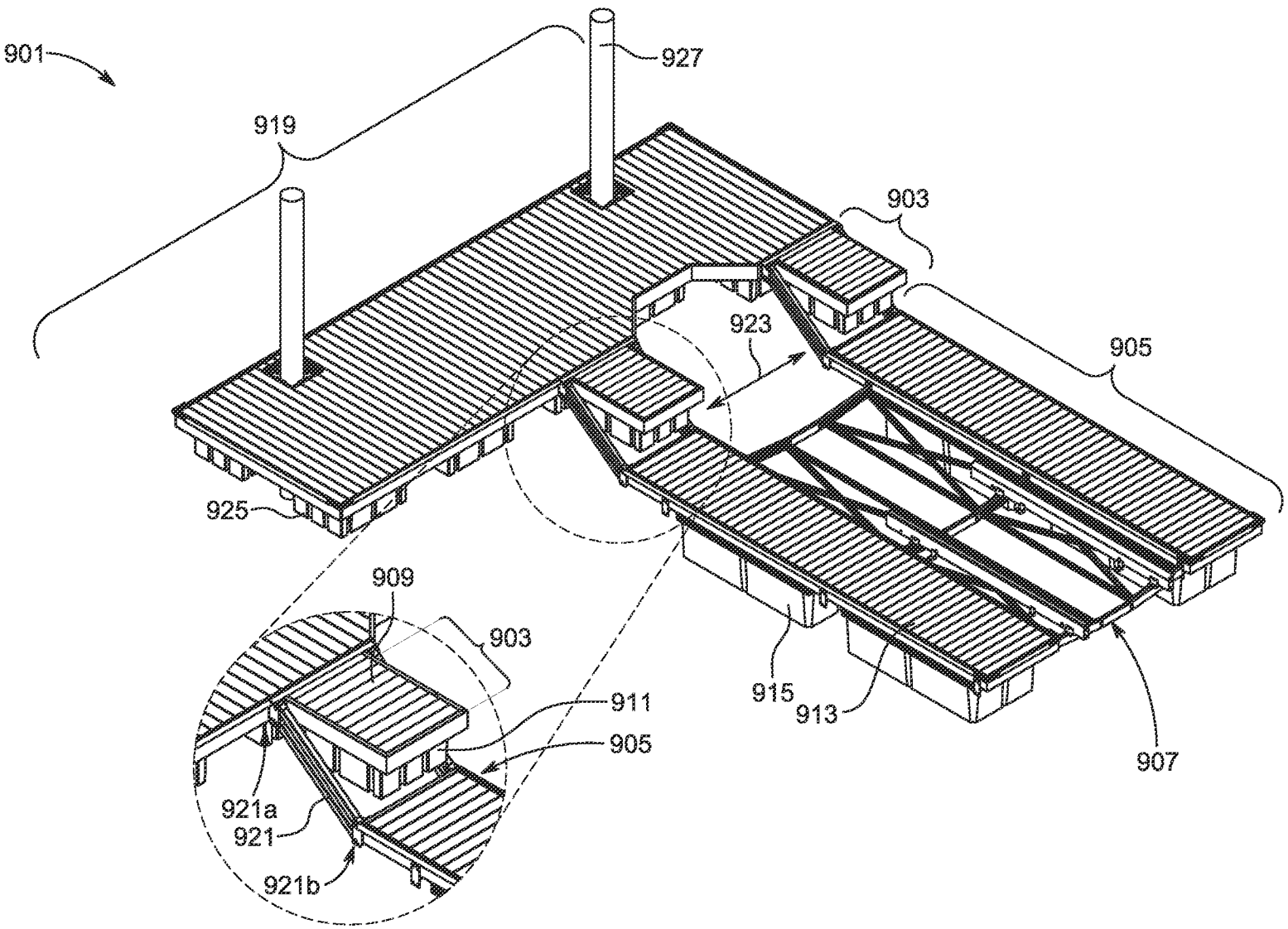
FIG. 9B is a perspective view of a floating lift system fully lowered in accordance with one or more embodiments of the present invention.
Figure 9C:
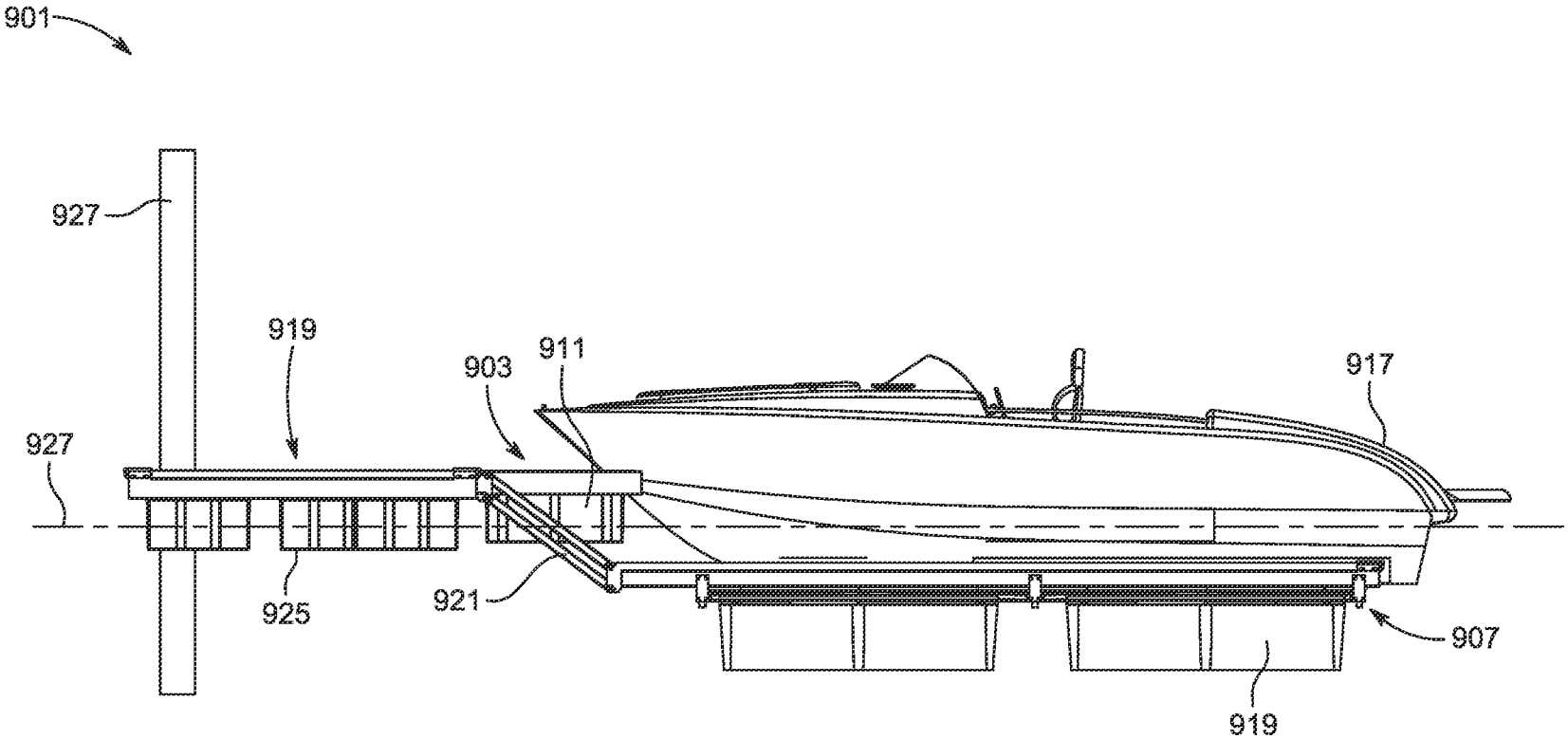
FIG. 9C is a profile view of a floating lift system fully lowered with a watercraft in accordance with one or more embodiments of the present invention.

Referring now to FIGS. 9A, 9B and 9C, various views of a floating lift system 901 are depicted. The floating lift system 901 includes a pair of elevator decks 903, a pair of lift decks 905, an air control system (such as the air control system 701 discussed above in FIG. 7), and a vessel cradle frame 907. Each elevator deck of the pair of elevator decks 903 comprise of a walking surface area 909 and a set of one or more foam-filled static floats 911. Each lift deck of the pair of lift decks 905 comprise of a walking surface area 913 and a set of one or more hollow lifting floats 915. The vessel cradle frame 907 is configured to support a vessel 917 thereon such as a motorboat, a canoe, a kayak, a speedboat, a rowboat, or the like.

The elevator decks 903 are securely attached to a parent dock 919 via a first end 921*a* of one or more link arms 921, wherein the pair the elevator decks 903 run parallel to each other with a predetermined length 923 therebetween. It should be noted that the set of one or more link arms 921 run parallel to the length of the lift decks 905. A second end 921*b* of the one or more link arms 921 engage with a proximal end of the lift decks 905, thereby positioning the lift decks 905 parallel to each other with the predetermined length 923 therebetween. It should be noted that the attachment of the lift decks 905 to the parent dock 919 via the elevator decks 903 create an F-shape. The vessel cradle frame 907 is positioned between the lift decks 905 and is securely attached to an interior side portion of each lift deck.

It should be appreciated that the first set of one or more static floats 911 provide static floatation to offset the weight of the one or more link arms 921 and the lift decks 905 from being borne by the parent dock 919. In addition, it should be appreciated that the link arms 921 are constructed similarly, if not the same, as the set 205 of link arms 207 discussed above in FIG. 3. Further, it should be appreciated that in this embodiment shown in FIGS. 9A-9C, the rotation axis of link arms 921 are parallel with the width of the lift deck 913. In contrast, in the embodiment shown in FIG. 3, the rotation of link arms 207 are parallel with the length of the lift deck 115.

It should also be appreciated that the parent dock 919 can be any existing floating or fixed dock or any floating or fixed dock currently in construction. In addition, it should be appreciated that the parent dock 919 can include a third set of one or more foam-filled static floats 925, one or more pilings 927, and a walking surface area 929. It should also be appreciated that although the elevator decks 903 are shown at a side portion of the parent dock 919, it is contemplated that the attachment of the elevator decks 903 to the parent dock 919 can vary in location, size, style, and the like.

In some embodiments, a user may utilize the walking surface areas 909, 913 as an extension of the walking surface area 923 of the parent dock 919 while the system is in the fully raised position. In one embodiment, the user may use the lift decks 905 to readily descend into and/or ascend from water during various activities including, without limitation, swimming, diving, aquatic physical therapy, and the like. In another embodiment, the user may use the lift decks 905 to readily raise and lower vessels into water including, without limitation, motorboats, canoes, kayaks, speedboats, rowboats, or the like.

Figure 10A:
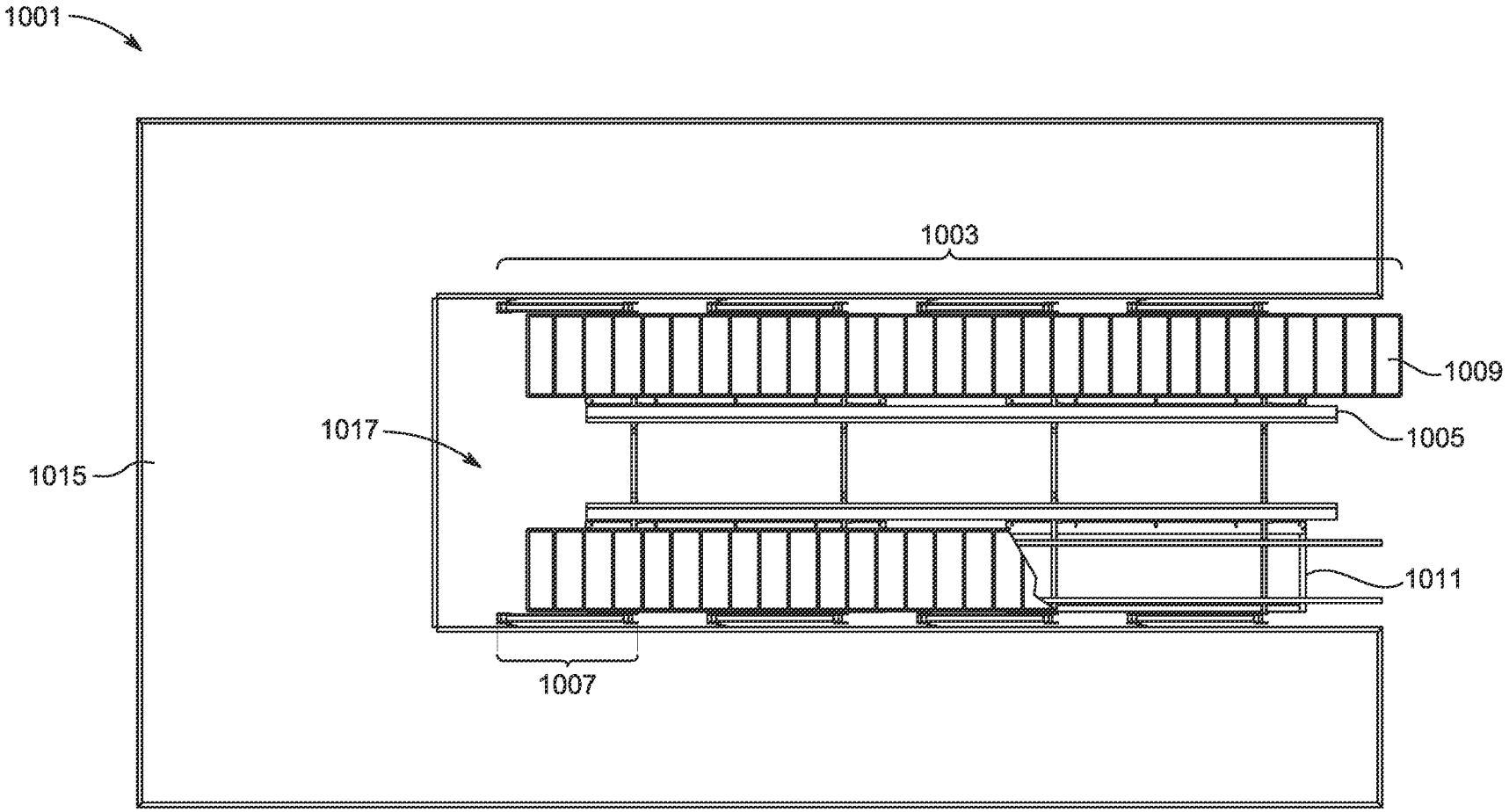
FIG. 10A is a top view of the floating lift system fully raised in accordance with one or more embodiments of the present invention.
Figure 10B:
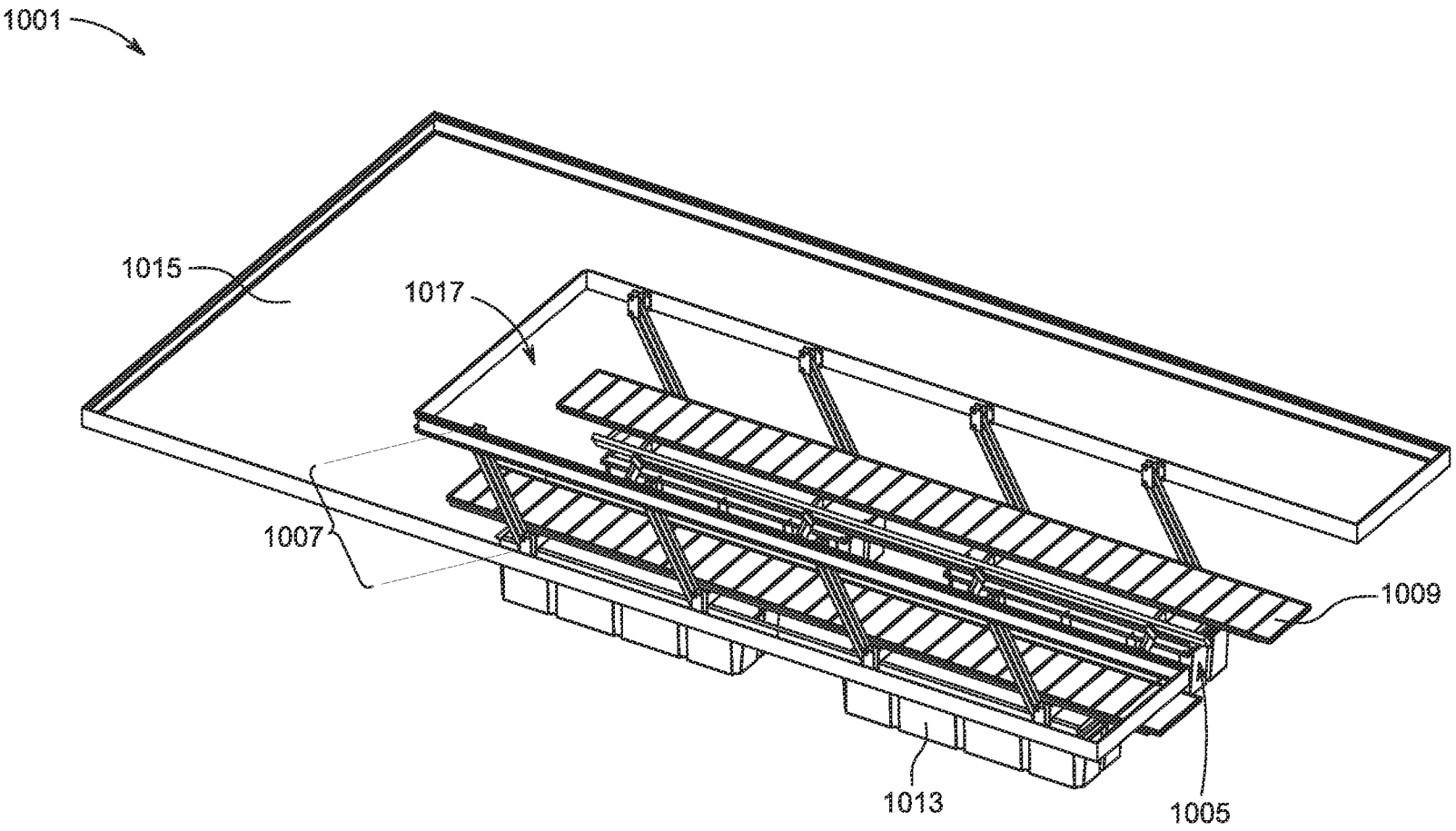
FIG. 10B is a perspective view of a floating lift system fully lowered in accordance with one or more embodiment of the present invention.

Referring now to FIGS. 10A and 10B, various views of a floating lift system 1001 are illustrated. As shown, the floating lift system 1001 includes a pair of lift decks 1003, an air control system (such as the air control system 701 discussed above in FIG. 7), and a vessel cradle frame 1005. The lift decks 1003 comprise of one or more link arms 1007, a walking surface area 1009, a subframe support 1011, and one or more hollow lift floats 1013. It should be appreciated that the rotation of the one or more link arms 1007 run parallel to the width of the lift decks 1003. The vessel cradle frame 1005 is configured to support a vessel thereon such as a motorboat, a canoe, a kayak, a speedboat, a rowboat, or the like.

In the contemplated embodiment, the floating lift system 1001 is mounted within a cavity 1017 of a horseshoe shaped parent dock 1015. A first end of the one or more link arms 1007 couples to an interior side portion of the parent dock 1015; and a second end of the one or more link arms 1007 couples to a side portion of each lift deck of the pair of lift decks 1003. It should be appreciated that the parent dock 1015 can be any existing floating or fixed dock or any floating or fixed dock currently in construction. In addition, it should be appreciated that the parent dock 1015 can include one or more foam-filled static floats, one or more pilings, and a walking surface area.

In some embodiments, a user may utilize the walking surface areas 1009 as an extension of walking surface area of the parent dock 1015 while the system is in the fully raised position. In one embodiment, the user may use the lift decks 1003 to readily descend into and/or ascend from water during various activities including, without limitation, swimming, diving, aquatic physical therapy, and the like. In another embodiment, the user may use the lift decks 1003 to readily raise and lower vessels into water including, without limitation, motorboats, canoes, kayaks, speedboats, rowboats, or the like.

Figure 11A:
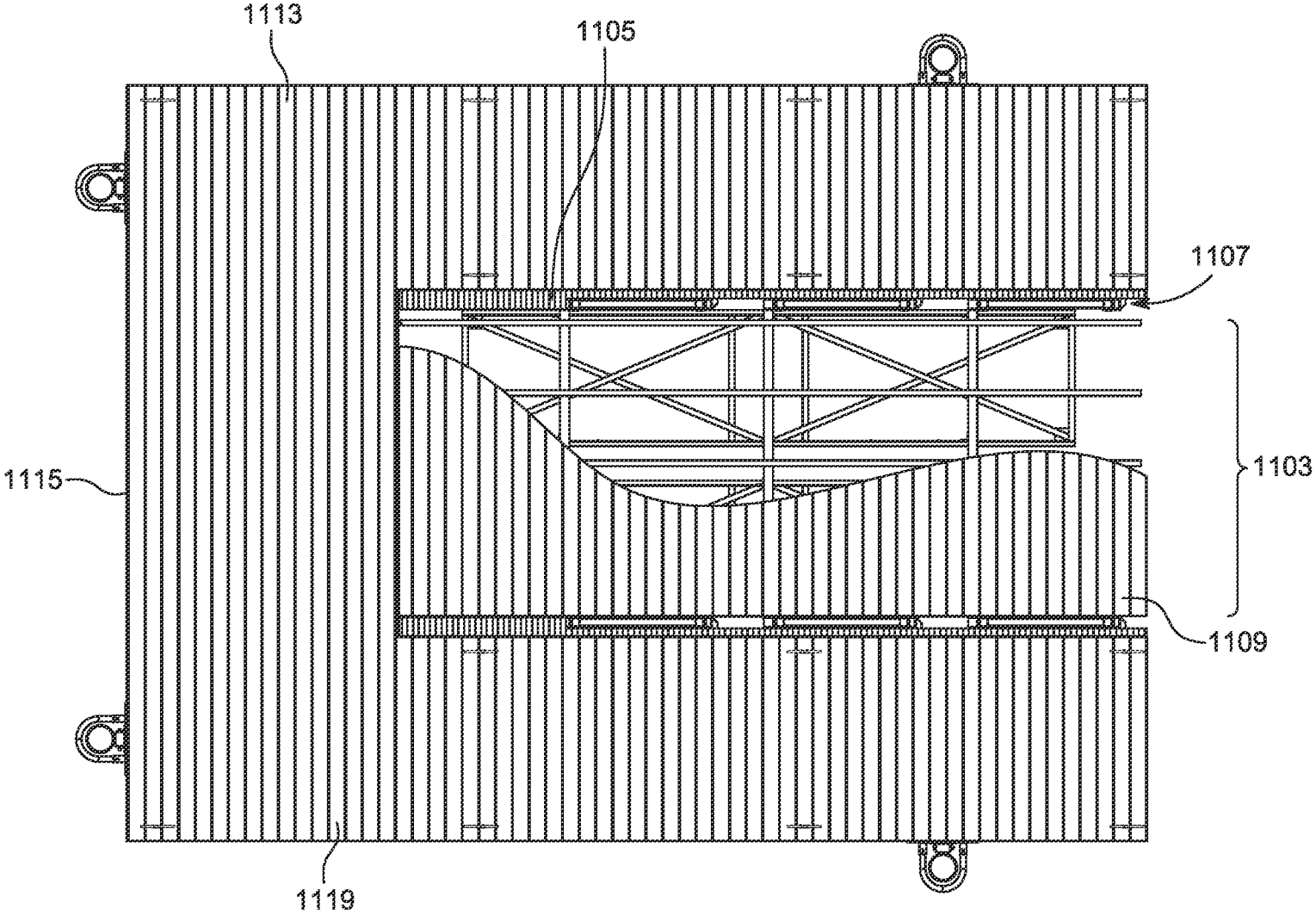
FIG. 11A is a top view of a floating lift system in a raised position in accordance with one or more embodiments of the present invention.
Figure 11B:
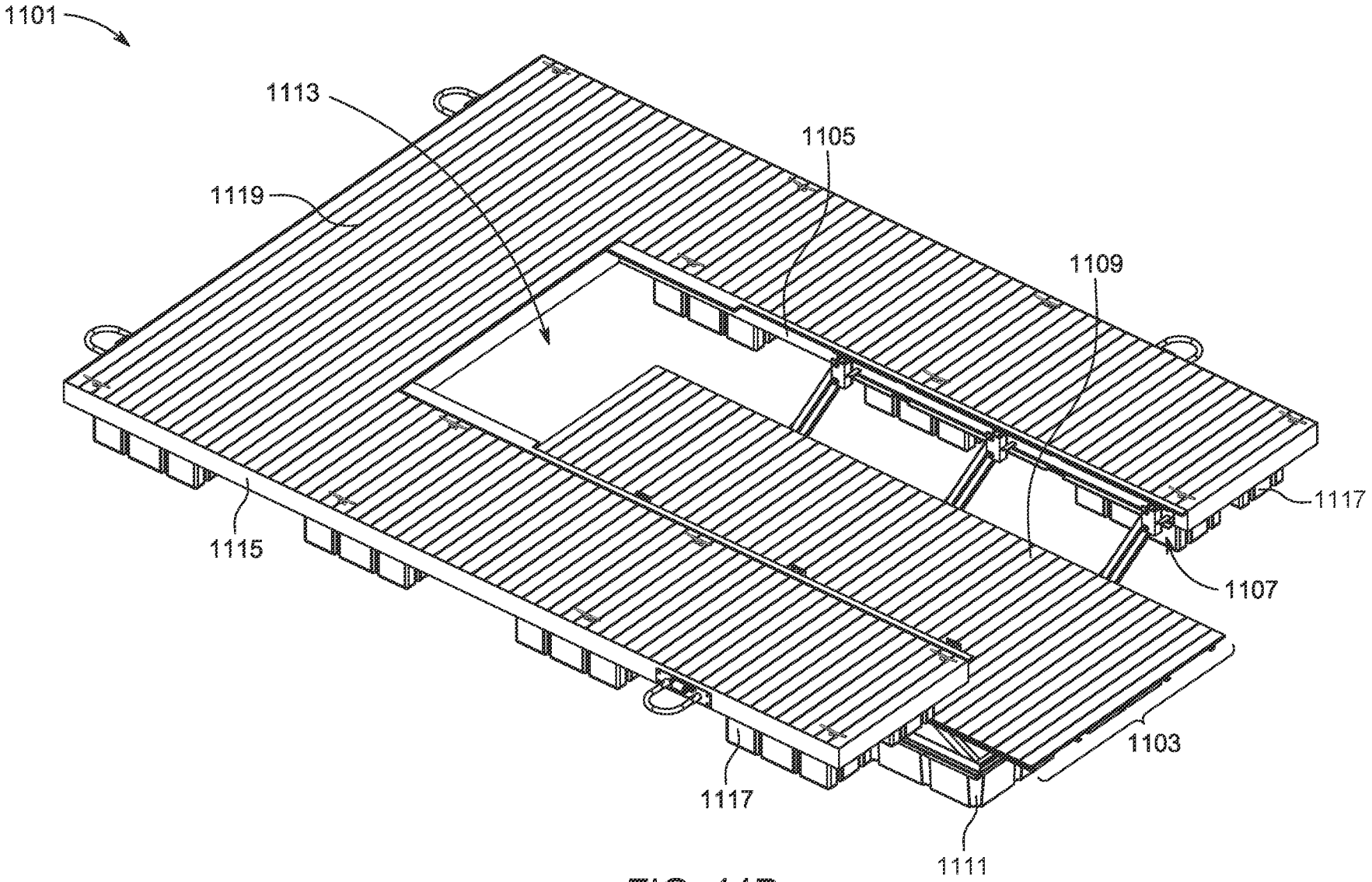
FIG. 11B is a perspective view of a floating lift system in a lowered position in accordance with one or more embodiments of the present invention.
Figure 11C:
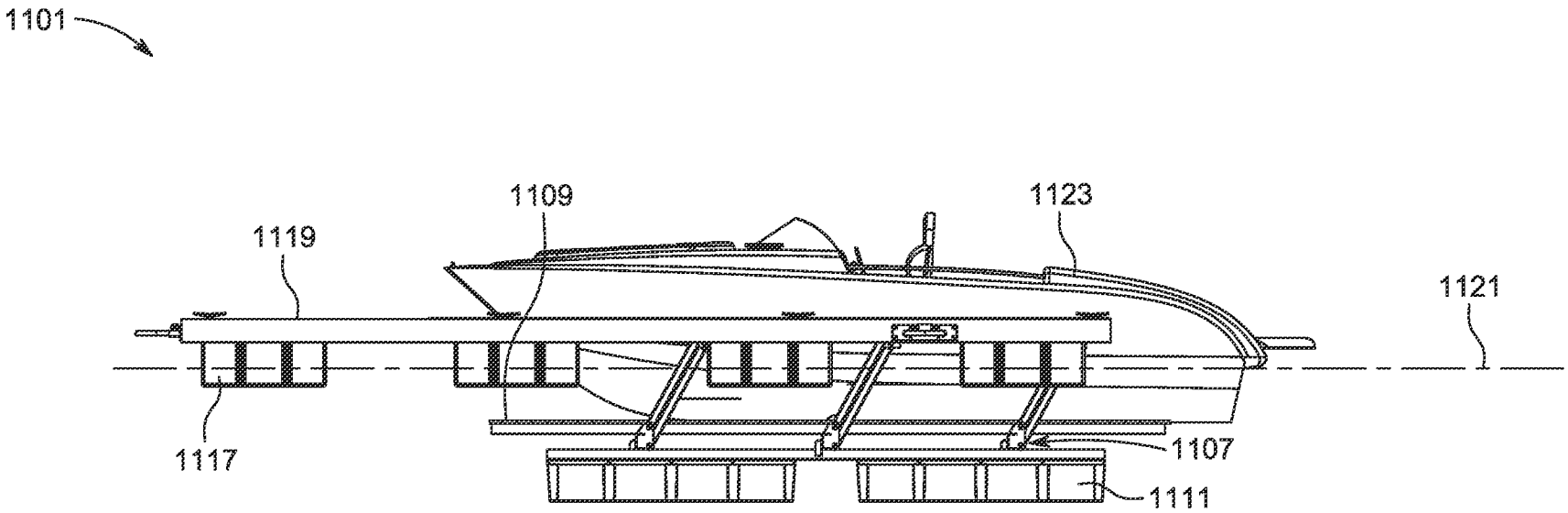
FIG. 11C is a profile view of a floating lift system in a lowered position with a watercraft in accordance with one or more embodiments of the present invention.

Referring now to FIGS. 11A through 11C, various views of a floating lift system 1101 are depicted. The floating lift system 1101 includes a lift deck 1103 and an air control system (such as the air control system 701 discussed above in FIG. 7). The lift deck 1103 includes a pair of parent dock adapters 1105, one or more link arms 1107, a walking surface area 1109, and one or more hollow lift floats 1111.

In the contemplated embodiment, the floating lift system 1101 is mounted within a cavity 1113 of a horseshoe shaped parent dock 1115 via parent dock adapters 1105. It should also be appreciated that the parent dock 1115 can be any existing floating or fixed dock or any floating or fixed dock currently in construction. In addition, it should be appreciated that the parent dock 1115 can include one or more foam-filled static floats 1117 and a walking surface area 1119.

During use, the lift deck 1103 moves forward and up via the one or more sets of link arms 1107 when rising. In the fully raised position, the lift deck 1103 is flush with the parent dock 1113. It should be noted that there is minimal gap between the lift deck 1103 and the parent dock 1115 while the lift deck 1103 is in the fully raised position in order to maintain aesthetics as well as to avoid opening between walking surface areas 1109, 1119. When lowering, the lift deck 1103 moves back and downward via the one or more sets of link arms 1107.

In some embodiments, a user may utilize the walking surface area 1109 as an extension of walking surface area 1119 of the parent dock 1115 while the system is in the fully raised position. In some embodiments, the user may use the lift deck 1103 to readily descend into and/or ascend from water 1121 during various activities including, without limitation, swimming, diving, aquatic physical therapy, and the like. In another embodiment, the user may use the lift deck 1103 to readily raise and lower a boat 1123 into water 1121.

Figure 12A:
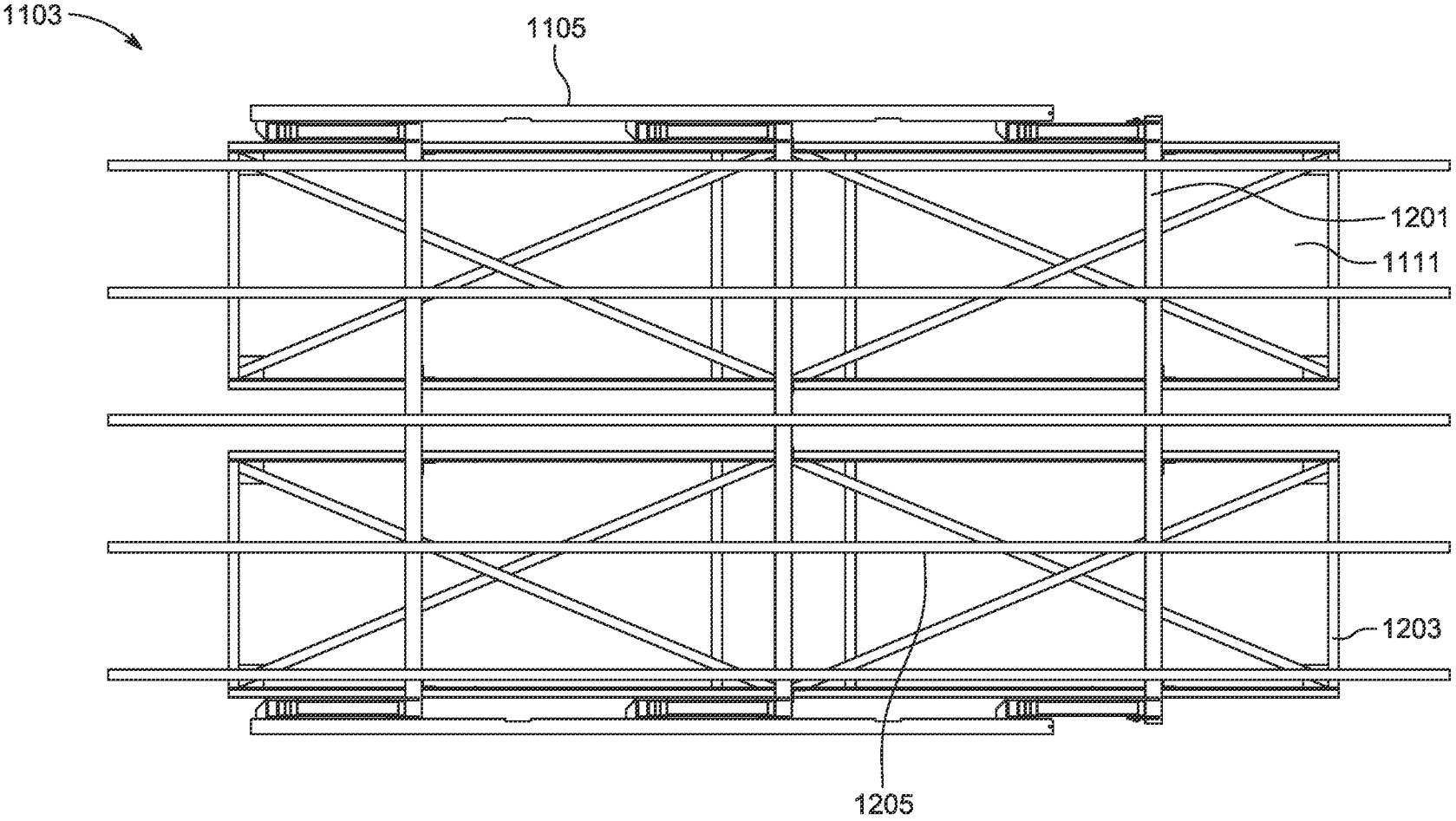
FIG. 12A is a top view of the lift deck of FIGS. 11A-11C in a raised position in accordance with one or more embodiments of the present application.
Figure 12B:
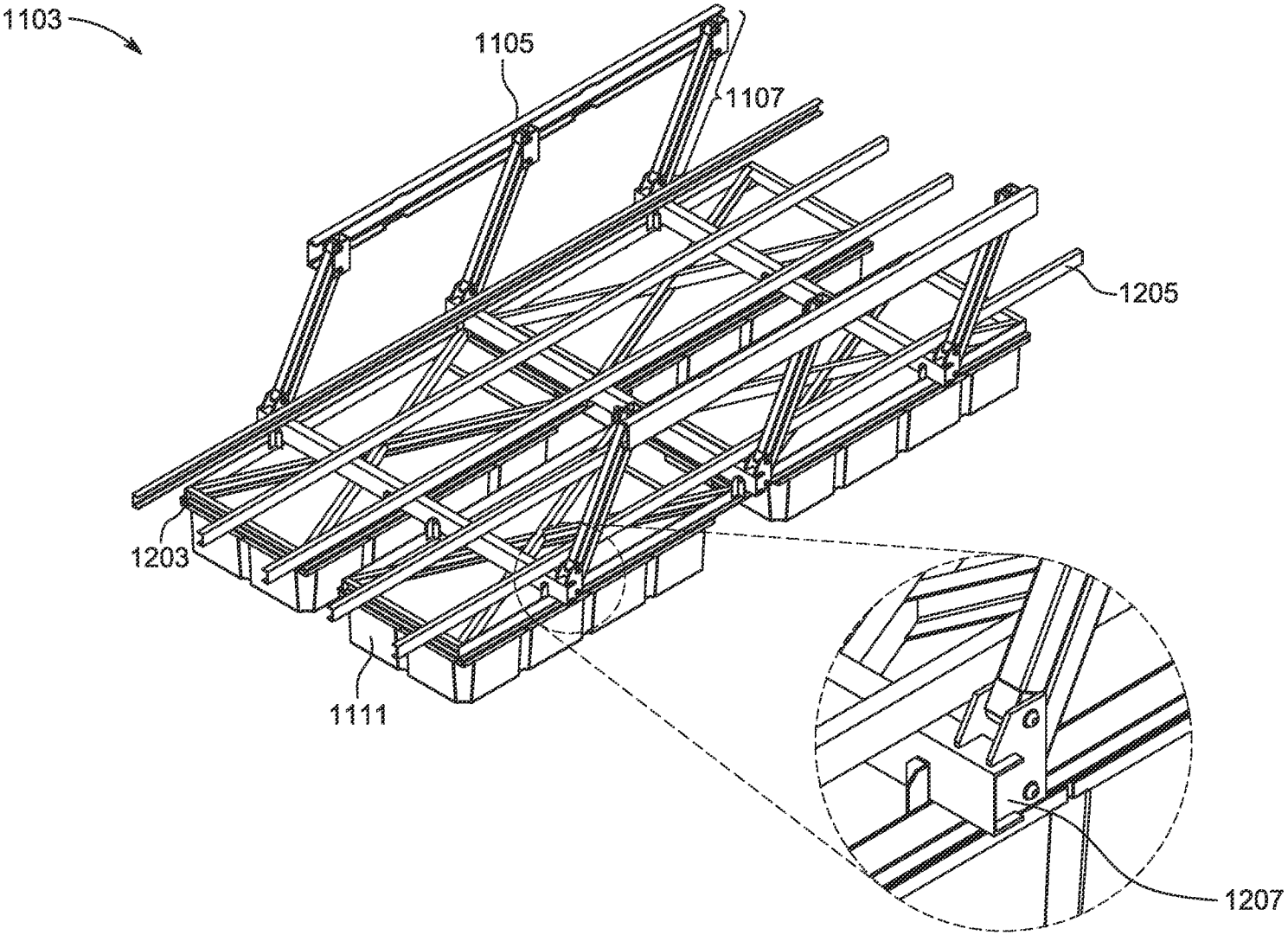
FIG. 12B is a perspective view of the lift deck of FIGS. 11A-11C in a lowered position in accordance with one or more embodiments of the present application.
Figure 12C:
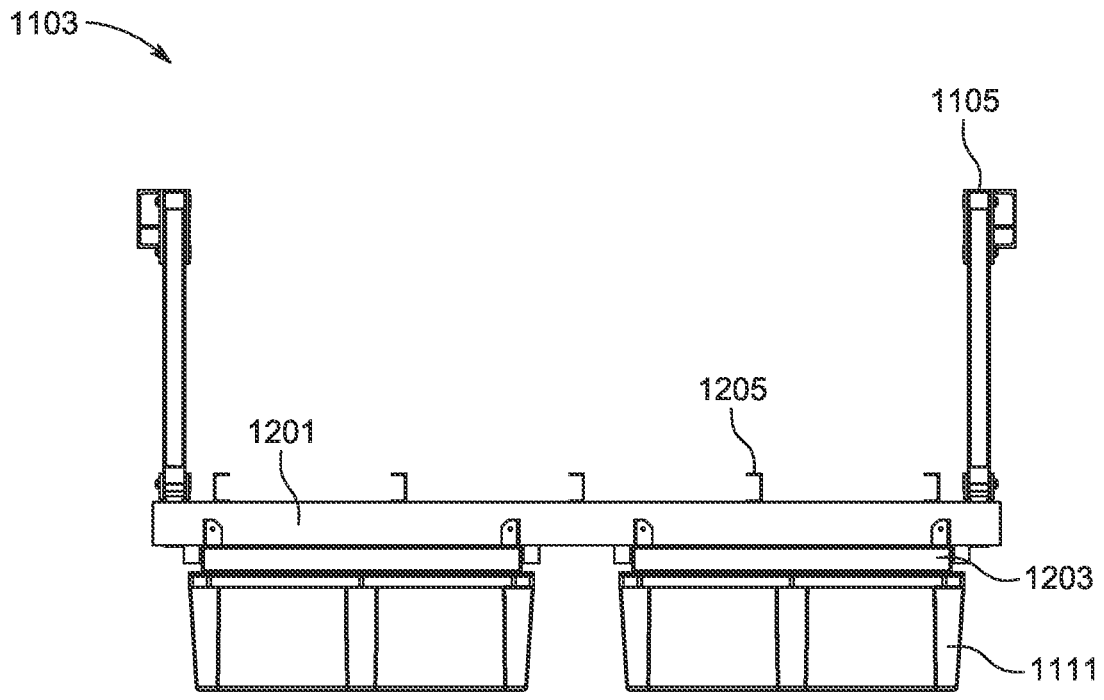
FIG. 12C is a front view of the lift deck of FIGS. 11A-11C in a lowered position in accordance with one or more embodiments of the present application.

In FIGS. 12A through 12C, various views of the lift deck 1103 are illustrated. As shown, the lift deck 1103 includes one or more support cross-members 1201, a pair of floatation air chamber frames 1203, one or more decking support joists 1205.

The one or more support cross-members 1201 perpendicularly extend between each parent dock adapter 1105. In addition, the one or more support cross-members 1201 securely couple to a first end of the one or more link arms 1107 via a link arm plate 1207. A second end of the one or more link arms 1107 securely couples to the pair of parent dock adapters 1105.

The floatation air chamber frames 1203 securely couples to the one or more support cross-members 1201. The one or more decking support joists 1205 parallelly extend the length of the lift deck and bisects the one or more support cross-members.

Figure 13A:
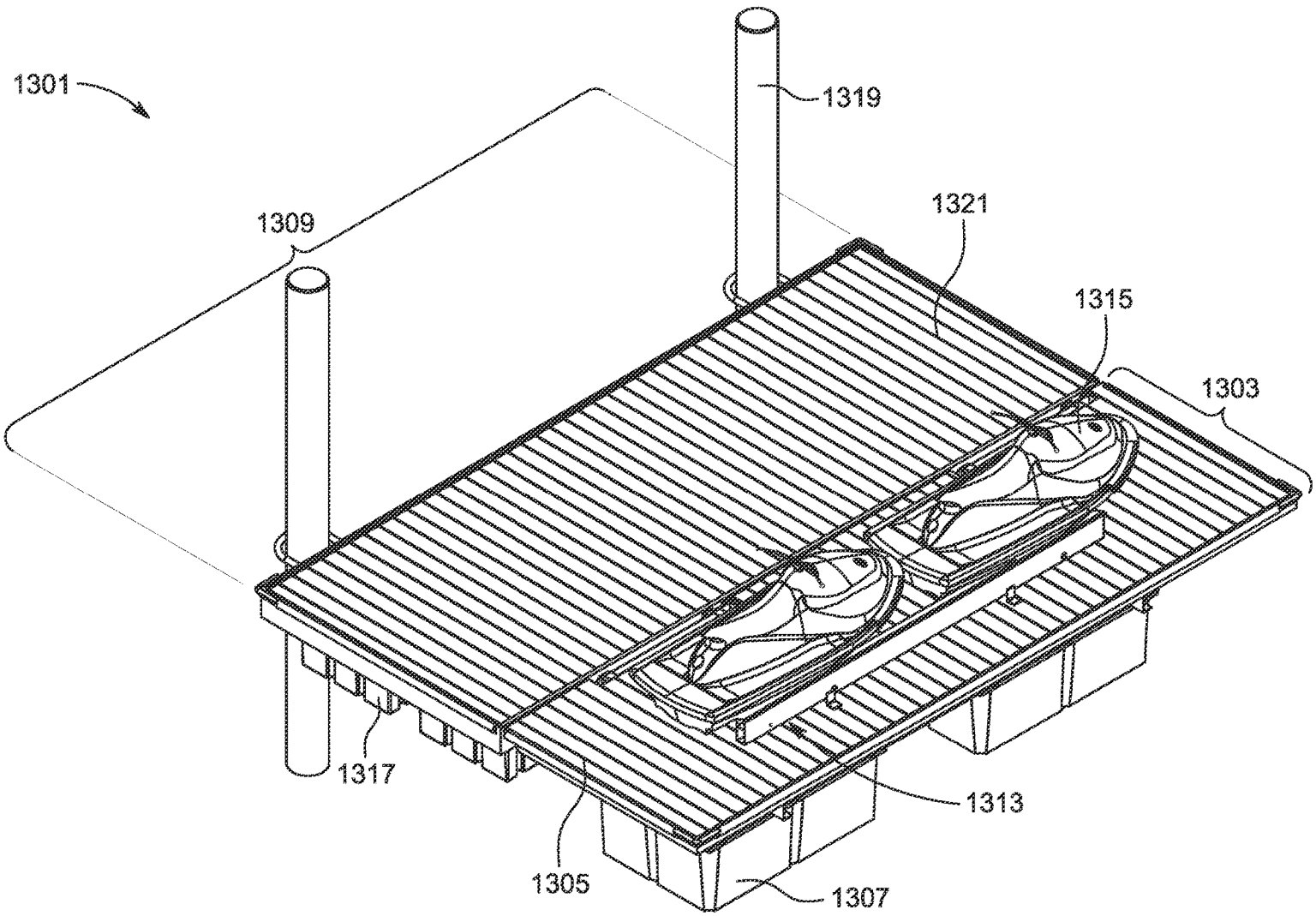
FIG. 13A is a perspective view of a floating lift system fully raised with a watercraft in accordance with one or more embodiments of the present invention.
Figure 13B:
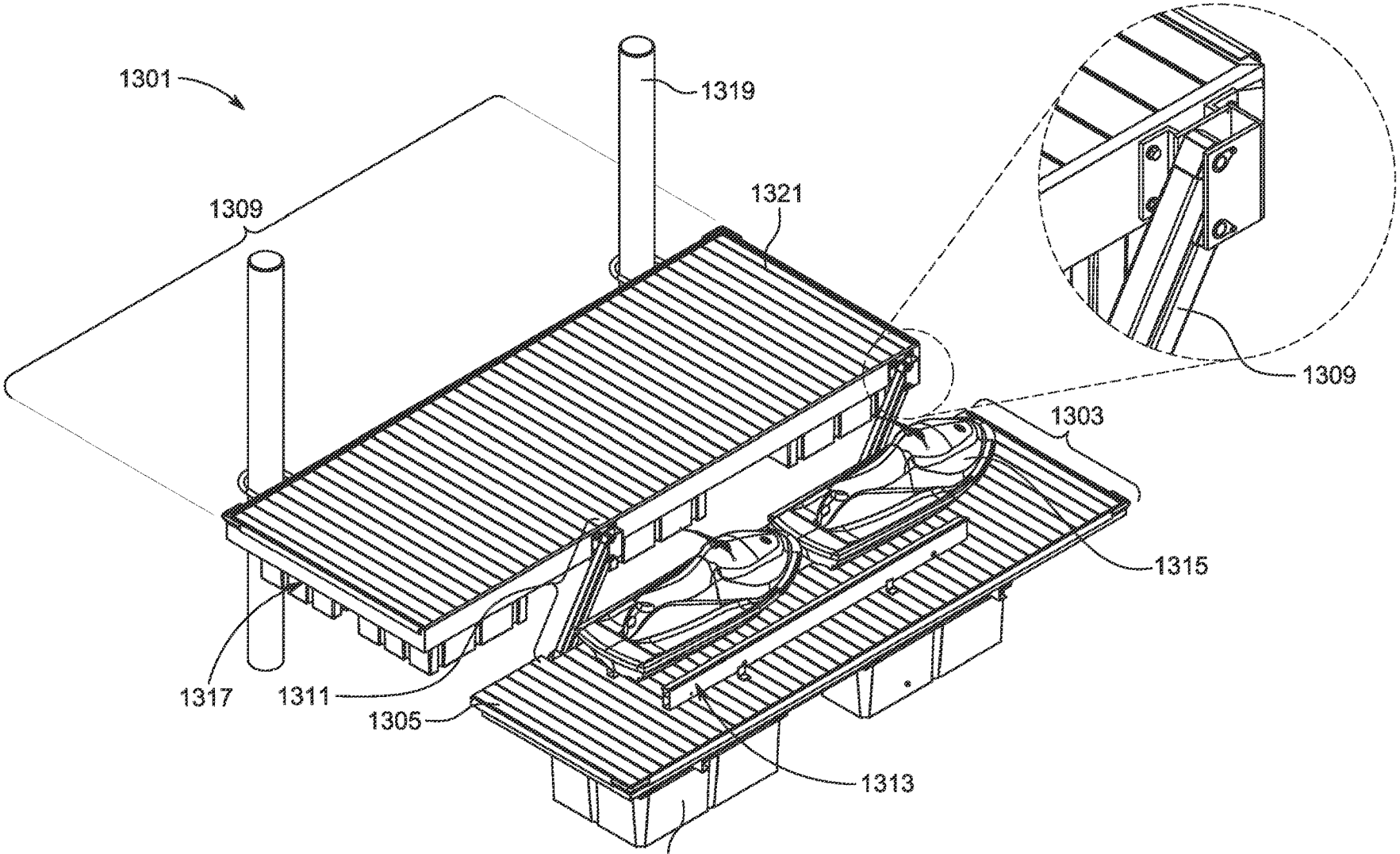
FIG. 13B is a perspective view of a floating lift system fully lowered with a watercraft in accordance with one or more embodiments of the present invention.

Referring now to FIGS. 13A and 13B, various views of a floating lift system 1301 are depicted. The floating lift system 1301 includes lift deck 1303 and an air control system (such as the air control system 701 discussed above in FIG. 7). The lift deck 1303 comprises of a walking surface area 1305 and one or more hollow lift floats 1307. The lift deck 1303 is configured to securely attach to a parent dock 1309 via one or more link arms 1311. The one or more hollow lift floats 1307 couple directly underneath the lift deck 1303.

The lift deck 1303 also includes one or more cradle arms 1313 configured to support a vessel 1315 including, without limitation, a motorboat, a canoe, a kayak, a speedboat, a rowboat, or the like. In the contemplated embodiment, the lift deck 1303 is configured to raise the vessel 1315 above water level (i.e., the lift deck 1303 becomes flush with the parent dock 1309) and to lower the vessel 1315 into water level.

It should be appreciated that the parent dock 1309 can be any existing floating or fixed dock or any floating or fixed dock currently in construction. In addition, it should be appreciated that the parent dock 1309 can include one or more foam-filled static floats 1317, one or more pilings 1319, and a walking surface area 1321. It should also be appreciated that the lift deck 1303 is shown mounted to the length of the parent floating dock 1309.

Figure 14A:
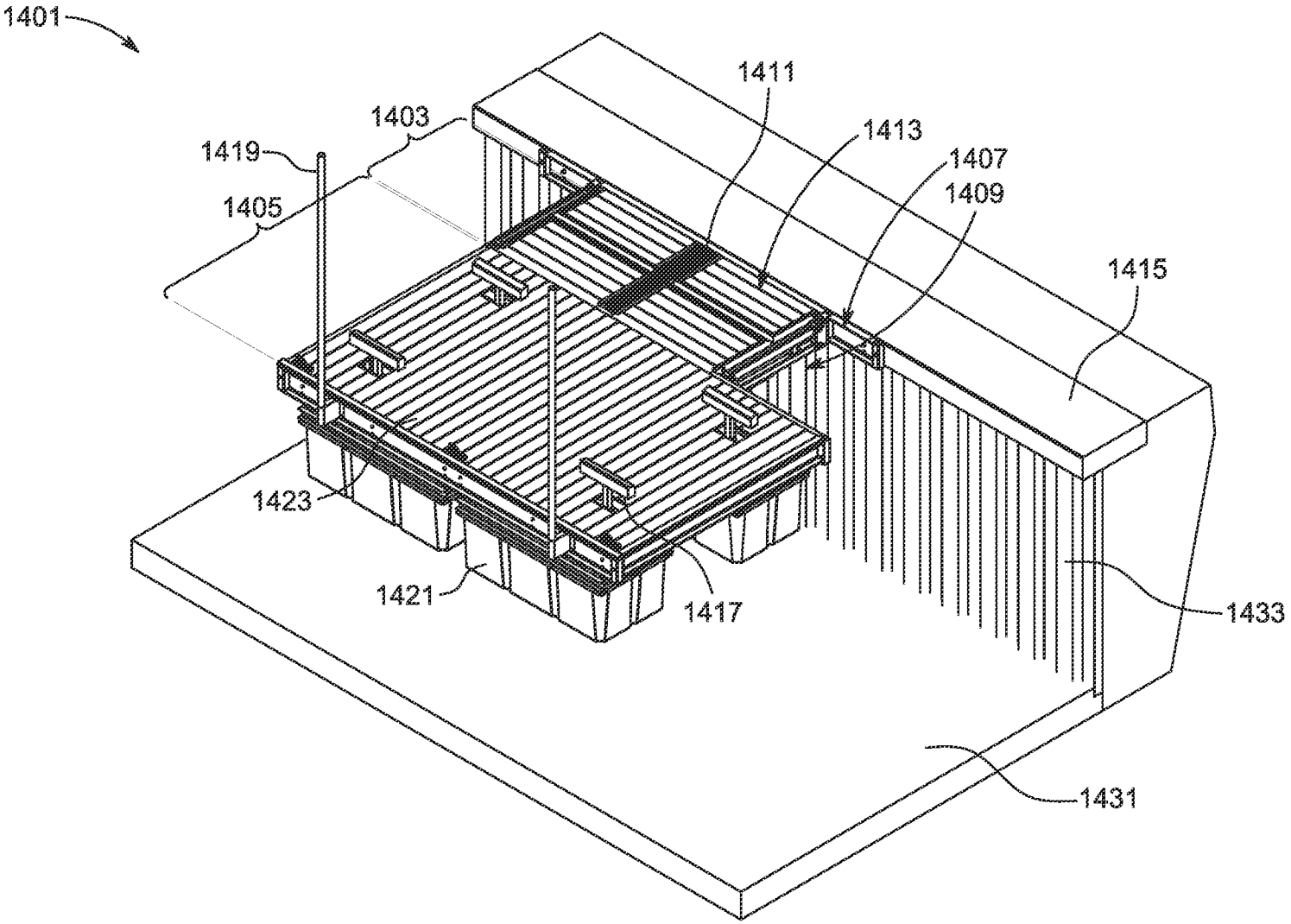
FIG. 14A is a perspective view of a floating lift system fully raised in accordance with one or more embodiments of the present invention.
Figure 14C:
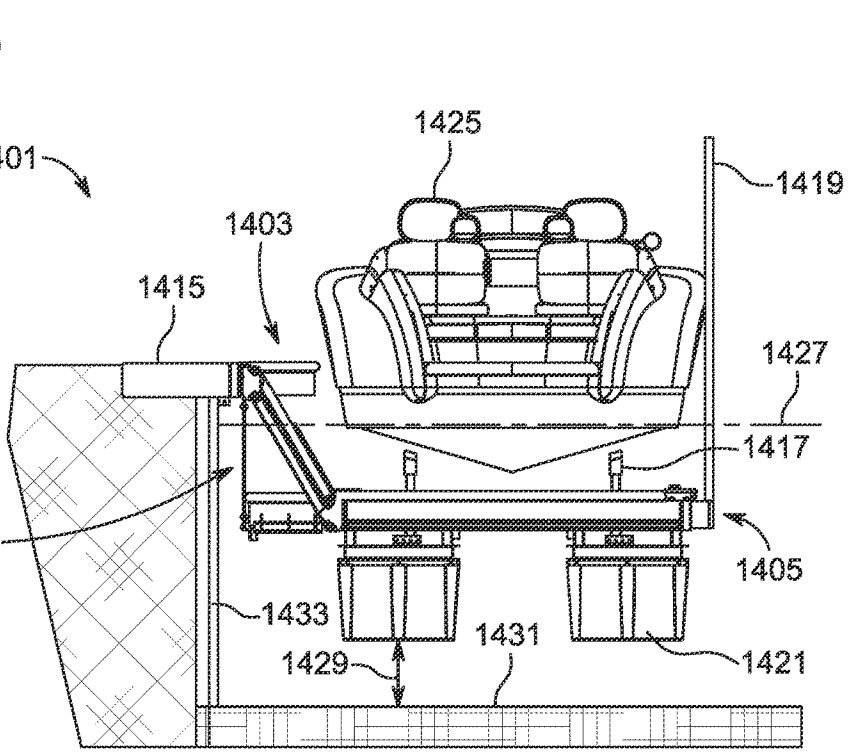
FIG. 14C is a profile view of a floating lift system fully lowered with a watercraft in accordance with one or more embodiments of the present invention.
Figure 14B:
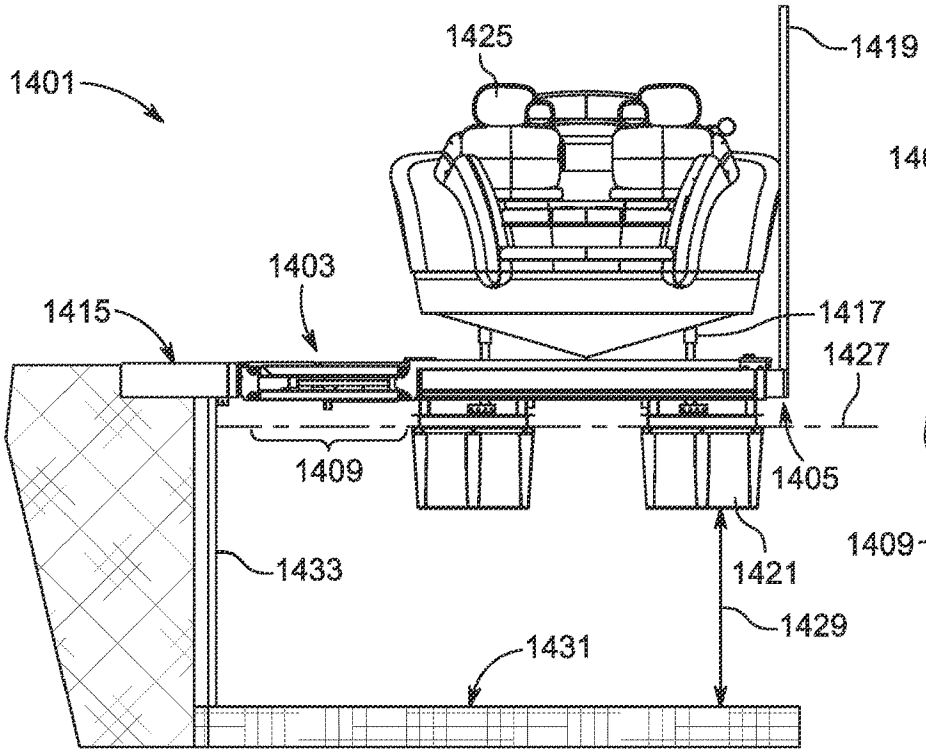
FIG. 14B is a profile view of a floating lift system fully raised with a watercraft in accordance with one or more embodiments of the present invention.

Referring now to FIGS. 14A through 14C, various views of a floating lift system 1401 are depicted. In the contemplated embodiment, the floating lift system 1401 includes an elevator deck 1403, a lift deck 1405, and an air control system (not shown, see FIG. 7 for further discussion). The elevator deck 1403 comprises of a bulkhead mount adapter 1407, a set of link arms 1409, one or more grating covers 1411, and a walking surface area 1413. The bulkhead mount adapter 1407 is configured to securely attach the elevator deck 1403 to a parent concrete bulkhead 1415. The set of link arms 1409 is configured to securely attach the lift deck 1405 to the bulkhead mount adapter 1407. It should be appreciated that the set of link arms 1409 are constructed similarly, if not the same, as the set 205 of link arms 207 discussed above in FIG. 3.

In some embodiments, the lift deck 1405 comprises of one or more vessel support bunks 1417, one or more guide-in posts 1419, one or more hollow lift floats 1421, and a walking surface area 1423. The one or more vessel support bunks 1417 are configured to support a vessel 1425. The one or more hollow lift floats 1421 couple directly beneath the lift deck 1405. It should be appreciated that the vessel support bunks 1417 and the guide-in posts 1419 can be removed to provide for a flat utility deck. In addition, it should be appreciated that the hollow lift floats 1421 are arranged in dual rows to support the dead weight on the set of link arms 1409, thereby eliminating the need for static type floats.

During use, when the user engages the one or more manual air valve operators (not shown, see FIG. 8 for further discussion) 801 to lower the lift deck 1405, air trapped within the one or more hollow lift floats 1421 escape to the atmosphere via the open-air circuit in the top of the lift floats 1421 whilst water is allowed to surge into the hollow lift floats 1421 via permanent openings the bottom of the hollow lift floats 1421, thereby causing the lift deck 1405 to descend. The lift deck 1405 continues to descend until either the one or more air valve operators are closed, the lift deck 1405 reaches the end of mechanical travel, or the slack in the one or more down limit cables (not shown, see FIG. 3 for further discussion) is taken up.

It should be noted that in the fully raised position, the lift deck 1405 is flush with the elevator deck 1403 and, by extension, the parent concrete bulkhead 1415. In addition, in the fully lowered position, there is clearance 1429 between the lift deck 1405 and the seabed 1431.

It should be appreciated that the parent concrete bulkhead 1415 can be any existing concrete bulkhead or any concrete bulkhead currently in construction. It should also be appreciated that the parent concrete bulkhead 1415 can include sheet piling 1433 as part of its construction.

In some embodiments, a user may utilize the walking surface areas 1413, 1423 as an extension of walking surface area of the parent concrete bulkhead 1415 while the system is in the fully raised position. In one embodiment, the user may use the lift deck 1405 to readily descend into and/or ascend from water during various activities including, without limitation, swimming, diving, aquatic physical therapy, and the like. In another embodiment, the user may use the lift deck 1405 to readily raise and lower vessels into water including, without limitation, motorboats, canoes, kayaks, speedboats, rowboats, or the like.

Figure 15A:
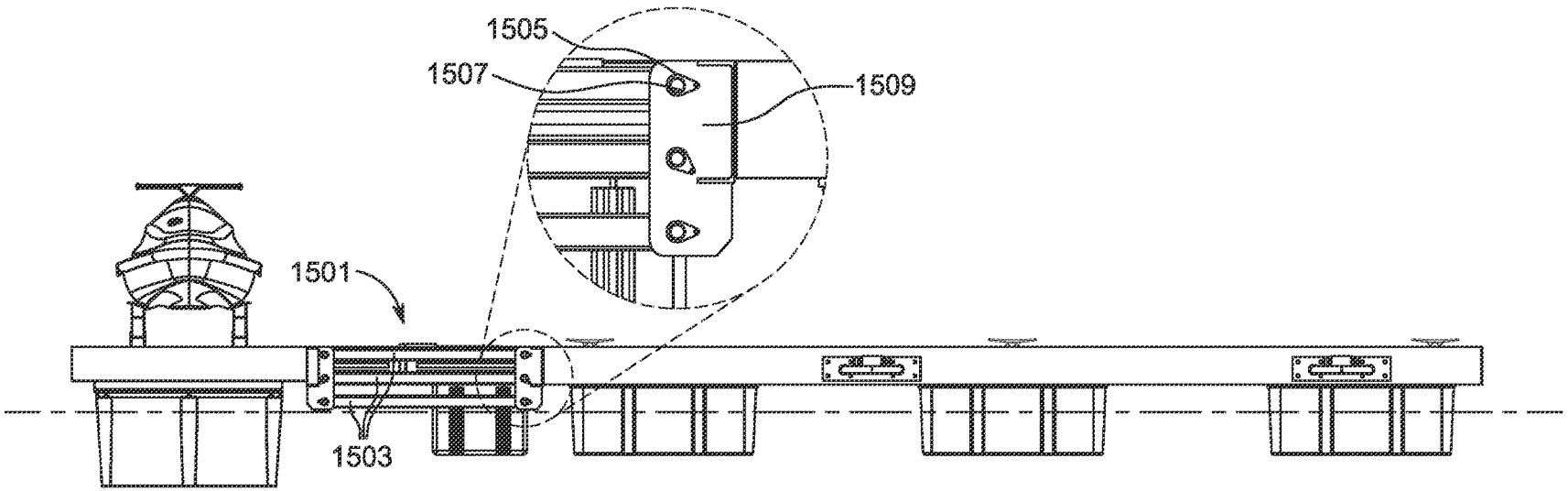
FIG. 15A is a profile view of an alternative set of link arms in a raised position in accordance with one or more embodiments of the present application.
Figure 15B:
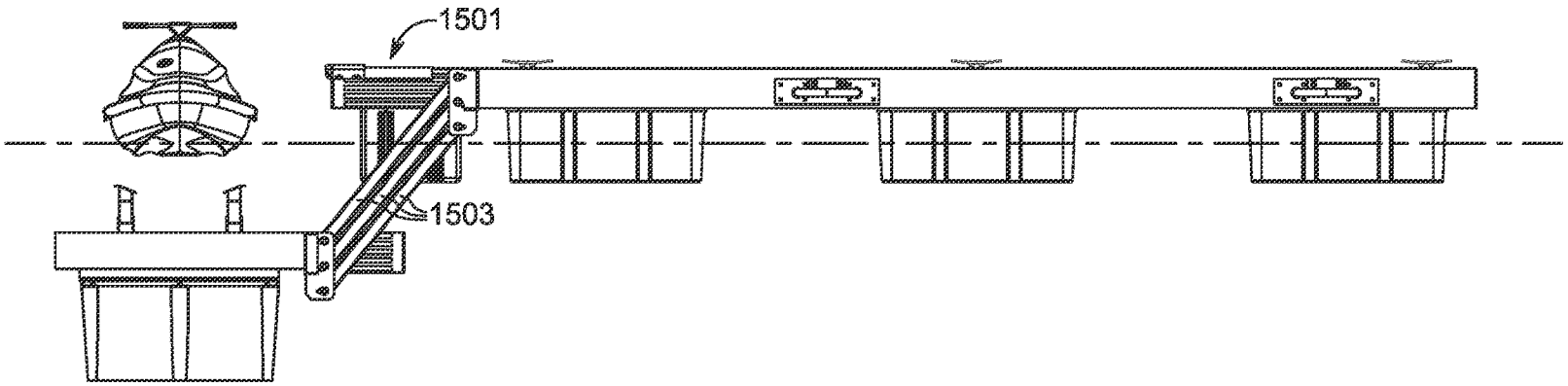
FIG. 15B is a profile view of an alternative set of link arms in a lowered position in accordance with one or more embodiments of the present application.

Referring now to FIGS. 15A and 15B, an alternative set of link arms 1501 in a raised position and a lowered position, respectively, are illustrated. In the contemplated embodiment, each link arm includes three elongated members 1503 wherein each opposing end of the members 1503 engage with link arm side plates 1505. The set of link arms 1501 also includes a plurality of pivot pins 1507 and a plurality of pin captive fasteners 1509 to securely fasten the members 1503 to the link arm side plates 1505.

It should be appreciated that the three members 1503 provide additional support for a lift deck such that the three members 1503 prevent the set of link arms 1501 to rack or twist when loads on the lift deck are unbalanced. Additionally, it should be noted that the set of link arms 1501 may be utilized in the systems disclosed herein to maintain a parallel deck relationship between a parent dock and the lift deck through entire range of motion.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A floating lift system for parent docks, comprising:

a pair of elevator decks, each elevator deck having:

a walking surface area; and a set of one or more foam-filled static floats coupled thereunder;

a pair of lift decks configured to support load being moved into and out of water along a vertical axis, each lift deck having:

a walking surface area;

a set of one or more hollow lift floats coupled thereunder;

an air control system configured to manage the displacement of pressurized air within the set of one or more hollow lift floats; and a vessel cradle frame configured to support a vessel thereon, the vessel cradle frame positioned between each lift deck of the pair of lift decks, the vessel cradle frame securely attached to an interior side portion of each lift deck;

wherein the pair of elevator decks are securely attached to a parent dock via a first end of one or more link arms;

wherein the pair of elevator decks run parallel to each other with a predetermined length therebetween;

wherein the one more of link arms run parallel to a length of the lift decks;

wherein a second end of the one or more link arms engage with a proximal end of the lift decks, thereby positioning the lift decks parallel to each other with the predetermined length therebetween, thereby creating an F-shape with the parent dock.

2. The floating lift system of claim 1, wherein the one or more link arms rotate at an axis parallel with a length of the pair of lift decks.

3. The floating lift system of claim 1, wherein the set of one or more foam-filled static floats provide static float to offset weight of the one or more link arms and the pair of lift decks from being borne by the parent dock.

4. The floating lift system of claim 1, wherein the one or more link arms further comprising:

at least two or more elongated members;

a pair of link arm side plates;

a plurality of pivot pins; and a plurality of pin captive fasteners;

wherein an opposing end of the at least two or more members engages with one of the pair of link arm side plates;

wherein the plurality of pivot pins and the plurality of pin captive fasteners securely fasten the at least two or more elongated members to the pair of link arm side plates.

5. A floating lift system for a horseshoe-shaped parent dock, comprising:

a pair of lift decks configured to support load being moved into and out of water along a vertical axis, each lift deck having:

a walking surface area;

a subframe support; and one or more hollow lift floats coupled thereunder;

one or more link arms configured to couple a side portion of each lift deck to an interior portion of a horseshoe-shaped parent dock, the one or more link arms including a rotation axis along a width of each lift deck;

a vessel cradle frame configured to support a vessel thereon, the vessel cradle frame positioned between each lift deck of the pair of lift decks, the vessel cradle frame securely attached to an interior side portion of a lift deck of the pair of lift decks; and an air control system configured to manage the displacement of pressurized air within the one or more hollow lift floats.

6. The floating lift system of claim 5, wherein the one or more link arms further comprising:

at least two or more elongated members;

a pair of link arm side plates;

a plurality of pivot pins; and a plurality of pin captive fasteners;

wherein an opposing end of the at least two or more members engages with one of the pair of link arm side plates;

wherein the plurality of pivot pins and the plurality of pin captive fasteners securely fasten the at least two or more elongated members to the pair of link arm side plates.

7. A floating lift system for a horseshoe-shaped parent dock, comprising:

a lift deck configured to support load being moved into and out of water along a vertical axis and a horizontal axis, the lift deck having:

a pair of parent dock adapters configured to couple the lift deck within a cavity of a horseshoe-shaped parent dock;

one or more link arms configured to move the lift deck forward and up when rising, and configured to move the lift deck back and downward when lowering;

one or more hollow lift floats; and a walking surface area;

an air control system of configured to manage the displacement of pressurized air within the one or more hollow lift floats.

8. The floating lift system of claim 7, wherein the lift deck further comprises:

one or more support cross-members perpendicularly extending between each parent dock adapter;

a pair of floatation air chamber frames securely coupled to the one or more support cross-members; and one or more decking support joists parallelly extending the length of the lift deck and bisects the one or more support cross-members;

wherein the one or more support cross-members securely couples to a first end of the one or more link arms via a link arm plate;

wherein a second end of the one or more link arms securely couples to a parent dock adapter of the pair of parent dock adapters.

9. The floating lift system of claim 7, wherein the one or more link arms further comprising:

at least two or more elongated members;

a pair of link arm side plates;

a plurality of pivot pins; and a plurality of pin captive fasteners;

wherein an opposing end of the at least two or more members engages with one of the pair of link arm side plates;

wherein the plurality of pivot pins and the plurality of pin captive fasteners securely fasten the at least two or more elongated members to the pair of link arm side plates.

* * * * *